US010858174B2

(12) United States Patent
Greco

(10) Patent No.: US 10,858,174 B2
(45) Date of Patent: Dec. 8, 2020

(54) CONTAINER FOR CONSUMER GOODS WITH RECLOSABLE FLAP

(71) Applicant: JT International S.A., Geneva (CH)

(72) Inventor: Gabriela Greco, Chêne-Bourg (CH)

(73) Assignee: JT International S.A.

( * ) Notice: Subject to any disclaimer, the term of this patent is extended or adjusted under 35 U.S.C. 154(b) by 0 days.

(21) Appl. No.: 16/613,175

(22) PCT Filed: May 15, 2018

(86) PCT No.: PCT/EP2018/062559
§ 371 (c)(1),
(2) Date: Nov. 13, 2019

(87) PCT Pub. No.: WO2018/210832
PCT Pub. Date: Nov. 22, 2018

(65) Prior Publication Data

US 2020/0180851 A1 Jun. 11, 2020

(30) Foreign Application Priority Data

May 18, 2017 (EP) ..... 17171835

(51) Int. Cl.
*B65D 85/10* (2006.01)
*B31B 50/00* (2017.01)
*B31B 50/88* (2017.01)

(52) U.S. Cl.
CPC ..... *B65D 85/1045* (2013.01); *B31B 50/0044* (2017.08); *B31B 50/88* (2017.08); *B65D 85/1018* (2013.01); *B65D 2203/02* (2013.01)

(58) Field of Classification Search
CPC .... B65D 5/54; B65D 5/6602; B65D 85/1018; B65D 85/1045; B65D 85/10568;
(Continued)

(56) References Cited

U.S. PATENT DOCUMENTS 9,167,851 B2 * 10/2015 Marchitto ..... B65D 85/1045
2014/0374290 A1 * 12/2014 Seyfferth De Oliveira ..... B65D 5/6602 206/268

(Continued)

FOREIGN PATENT DOCUMENTS

WO 2008142540 A1 11/2008
WO 2012089812 A1 7/2012

(Continued)

OTHER PUBLICATIONS

Extended European Search Report including the Written Opinion for Application No. EP 17171835.6 dated Nov. 23, 2017, 8 pages.

(Continued)

*Primary Examiner* — Luan K Bui
(74) *Attorney, Agent, or Firm* — Lerner, David, Littenberg, Krumholz & Mentlik, LLP

(57) ABSTRACT

A container for consumer goods, such as smoking articles, has an outer housing with a hinged lid that houses an inner package of consumer goods. The inner package has an access opening through which consumer goods can be removed and that is covered by a reclosable flap, which is attached to a first lid panel that is relatively movable to a second lid panel during rotation of the lid between lid open and closed positions. The reclosable flap is attached to the hinged lid such that a portion of the reclosable flap is substantially coplanar with a planar wall of the hinged lid. An indicium is provided at the portion of the reclosable flap that is coplanar with the planar wall. A method of forming the container is also provided.

7 Claims, 19 Drawing Sheets

(58) Field of Classification Search
CPC . B65D 2203/02; B31B 50/0044; B31B 50/88; B65B 19/22; B65B 61/18
USPC ..... 206/256, 268, 273; 229/87.14, 160.1
See application file for complete search history.

(56) References Cited

U.S. PATENT DOCUMENTS

| | | | | |
|---|---|---|---|---|
| 2015/0021219 | A1* | 1/2015 | Seyfferth De Oliveira | B65D 85/1045 206/268 |
| 2015/0034509 | A1* | 2/2015 | Seyfferth De Oliveira | B65D 85/1045 206/268 |
| 2017/0203910 | A1* | 7/2017 | Buse | B65D 83/0072 |
| 2018/0334316 | A1* | 11/2018 | Buse | B65B 61/02 |
| 2018/0346235 | A1* | 12/2018 | Buse | B65D 75/5838 |

FOREIGN PATENT DOCUMENTS

| | | | |
|---|---|---|---|
| WO | 2016059077 | A1 | 4/2016 |
| WO | 2017108164 | A1 | 6/2017 |

OTHER PUBLICATIONS

International Search Report from Application No. PCT/EP2018/062559 dated Jul. 10, 2018, 2 pages.

* cited by examiner

CONTAINER FOR CONSUMER GOODS WITH RECLOSABLE FLAP

CROSS-REFERENCE TO RELATED APPLICATIONS

The present application is a national phase entry under 35 U.S.C. § 371 of International Application No. PCT/EP2018/062559, filed May 15, 2018, published in English, which claims priority to European Patent Application No. 17171835.6, filed May 18, 2017, the disclosures of which are incorporated herein by reference.

BACKGROUND OF THE INVENTION

The present invention relates to a container for consumer goods, in particular a container for smoking articles.

Some cigarette containers comprise a rigid outer housing and a sealed inner package within which cigarettes are contained, such as described in WO 2008/142540. Those containers have a resealable extraction opening in the inner sealed package selectively covered by a cover flap. The cover flap is connected to a hinged lid so that opening and closing the lid simultaneously opens and closes the cover flap over the resealable extraction opening. The cover flap is fixed to the inner package using an adhesive which extends about the whole of the extraction opening so that the cover flap can be detached from the inner package and fixed back again. This can allow the cover flap to seal cigarettes within the inner package when the lid is closed.

With those conventional pack structures, it is challenging to select a bonding strength of the adhesive surfaces adequate for a high quality sealing throughout the life of the container and that allows opening the lid, especially when the container is opened for the first time. If too strong, first opening causes damage to the lid, especially at the hinge and side panels, and, if too weak, attachment of the cover flap to the inner package fails and could even rub off after a number of openings. Further, such a selection has to be done for each combination of cover flap and inner package material or texture.

Several solutions to this problem have been proposed based on a reduction of the effective adhesion area. These solutions are still found unsatisfactory for they are complex and still dependent on the adhering surfaces, thus, only partially addressing the problem.

Another problem identified in these containers is that, once some cigarettes are removed from the inner package, repositioning of the cover flap to the inner package is notoriously less precise, even causing reattachment problems.

To solve this problem there have been attempts to use either more complex, and therefore costly, materials, especially for the cover flap, or to rigidise the inner package, for example, by using stiff inner frames located under the sealed package and that surround the cigarettes almost entirely. These solutions are still unsatisfactory as they are more costly and increase manufacturing complexity.

Yet another problem is that loose tobacco crumbs can become affixed to the adhesive, which can be unpleasant for users and can diminish the effectiveness of the adhesive. A further problem is that, under certain atmospheric conditions, the sealing provided by known cover flaps can actually be detrimental to the preservation of tobacco in smoking articles. Still another problem connected to these containers is the difficulty to open them for the first time, especially when provided with a seal or stamp at the line of closure of the lid as proof that the container has not been tampered with.

Another known container is described in WO 2012/089812. In this arrangement a cover layer is provided with an embossed indicium on an inner surface of an adhesive label. The embossed indicium is visible when the cover layer is moved from the closed position to the open position. However, movement of the cover flap between the closed and open positions can cause distortion of the embossed indicium, which may create undesirable viewing effects.

BRIEF SUMMARY OF THE INVENTION

Therefore, it is an object of the invention to provide an improved container for consumer goods with a reclosable flap. Another object of the invention is to provide a blank for forming an outer housing of the improved container.

According to a first aspect of the invention there is provided a container for consumer goods, comprising: an outer housing comprising a box and a hinged lid rotatable between open and closed positions, wherein a lower front edge of the lid abuts a free edge of a box front wall when the lid is in the closed position; an inner package of consumer goods within the outer housing comprising an access opening through which consumer goods can be removed; a reclosable flap movable relative to the inner package about a hinge line and arranged to cover the access opening, the reclosable flap having a free end attached to the hinged lid; wherein, in an open position in which a lid top wall is arranged substantially perpendicular to a box back wall, a straight line between the lower lid front edge and the hinge line measures a first distance; wherein a length along the reclosable flap between the hinge line and its free end measures a second distance; wherein a ratio between the first distance and the second distance is comprised between 70% and 100%.

In this way, the reclosable flap can be held in tension when the hinged lid is in the open position. This is achieved because the second distance is either the same as the first distance or is slightly longer. This minimises the potential for any slack in the reclosable flap when the lid is in the open position. Advantageously this can assist movement of the hinged lid from the open position towards the closed position. In addition, it can improve the positioning of the reclosable flap against the inner package when the hinged lid is moved from the open position to the closed position. In particular, it can improve the positioning of the reclosable flap along the top wall of the inner package to ensure that an effective seal is created and to assist with the preservation of the consumer goods.

The ratio may be at least 75%, for example at least 80%, such as at least 85%. It has been found that these ratios can provide the reclosable flap with the desired amount of tension when the hinged lid is in the open position.

The ratio may be of no more than 95%, for example of no more than 90%. It has been found that these ratios provide the reclosable flap with the desired amount of tension when the hinged lid is in the open position while limiting the risk of damaging the reclosable flap or the inner package, such as tearing the inner package.

In one arrangement the hinge line may be positioned at a top wall of the inner package at a distance that is at least 20% of the distance from a top, back edge of the inner package to a top, front edge of the inner package. This distance may be at least 25%, such as at least 30%. This relative distance can provide the reclosable flap with the desired amount of tension when the hinged lid is in the open position. By positioning the hinge line at the top wall of the inner package at a distance that is no more than 40% of the distance from the top, back edge of the inner package to the top, front edge of the inner package, accessibility to the consumer goods is eased. This distance may be no more than 35% to provide further accessibility to the consumer goods, especially for consumer goods stacked in three rows between a back surface and a front surface of the inner package. Where the consumer goods are smoking articles, the smoking articles may be positioned in three rows between the front and back surfaces of the inner package and it is advantageous to position the hinge line close to the interface between the back row of smoking articles and the middle row of smoking articles.

When the container has dimensions similar to those of a conventional smoking article container, the hinge line may be positioned at a top wall of the inner package at a distance of at least 5 mm from a top, back edge of the inner package, for example of at least 6 mm, such as of at least 7 mm. Similarly, the hinge line may be positioned at a distance of no more than 9 mm, for example of no more than 8 mm.

Thus, the hinge line may be positioned further away from the top, back edge of the inner package than has been considered typical. This can advantageously increase tension in the reclosable flap when the hinged lid is in the open position while still permitting easy access to the consumer goods through the access opening.

The reclosable flap may be attached to the inner package so that a portion of the reclosable flap is movable relative to the inner package during lid movement, while another portion of the reclosable flap is not movable during lid movement. For example, the non-movable portion of the reclosable flap may be attached to the inner package by a permanent adhesive, preferably by one or more strips of permanent adhesive. In this arrangement, the hinge line delimits the movable and non-movable portions of the reclosable flap.

In another configuration the access opening may be provided by a cut line or a line of weakness that defines a flap in the outer surface of the inner package. The hinge line of the reclosable flap may substantially coincide with a hinge line of the flap in the outer surface of the inner package. Thus, the hinge line may substantially coincide with a rear edge of the access opening.

In this case, the inner package may comprise an adhesive label that is adhered to its inner surface in a portion where the reclosable flap overlies the adhesive label. The access opening can then be provided in the adhesive label, for example, by a cut-out or a line of weakness, or a cut line, which defines a flap that covers the access opening.

The reclosable flap may be attached to a first lid panel of the hinged lid, and the first lid panel may be relatively movable to a second lid panel during movement of the lid between the open and closed positions.

In some embodiments, in a first open position the hinged lid may be rotated through substantially 180° from the closed position so that a back wall of the hinged lid is substantially parallel to a back wall of the box. In the closed position a back wall of the hinged lid may be parallel with a back wall of the box. In the first open position the back wall of the hinged lid may be folded backwards relative to the back wall of the box so that it is parallel and adjacent to the back wall of the box.

A back wall of the hinged lid may be in contact with a back wall of the box in a second open position. Preferably the second open position of the hinged lid corresponds to a "fully open" position of the hinged lid, which is at an extreme end of the normal operating movement of the lid. Similarly, the closed position of the hinged lid preferably corresponds to a "fully closed" position at the other extreme end of the normal operating movement of the lid. The first open position is therefore provided between the closed position and the second open position.

An angle between the first lid panel and the front wall of the hinged lid may decrease when the hinged lid is rotated from the first open position to the second open position. Preferably the angle may be decreased from substantially 90°. Thus, the first lid panel may be substantially perpendicular to a front wall of the hinged lid when the hinged lid is in the first open position. This has been found to assist in tensioning the reclosable flap in the first open position.

For example, the first lid panel may be hingedly connected (e.g. by a crease line) to the second lid panel. In this case, the first lid panel may be substantially perpendicular to the second lid panel in the first open position and the first lid panel may rotate towards the second lid panel when the lid is rotated away from the closed position past the first open position.

In some embodiments, the hinge line may be positioned at a top wall of the inner package at a distance from a top, back edge of the inner package that is substantially the same or shorter than a length of the first lid panel. The ratio between the length of the first lid panel and the distance between the hinge line and the top, back edge of the inner package is preferably comprised between 1 and 3. This has been found to provide an adequate amount of tension to assist movement of the reclosable flap from the open position towards the closed position while limiting the risk of damaging the inner package or the reclosable flap due to excessive tension in the open position.

To further improve reclosable flap closing, the ratio between the length of the first lid panel and the distance between the hinge line and the top, back edge of the inner package may be of at least 1.1, for example of at least 1.2, for example of at least 1.3, such as of at least 1.4.

To further reduce the risk of damaging the inner package or the reclosable flap, the ratio between the length of the first lid panel and the distance between the hinge line and the top, back edge of the inner package may be of no more than 2.5, for example of no more than 2.2, for example of no more than 2, such as of no more than 1.8.

Preferably a portion of the reclosable flap is held in a substantially flat, tensioned configuration between the hinge line and the hinged lid when the hinged lid is in the first open position. The length of the substantially flat portion of the reclosable flap may be increased when the hinged lid is rotated from the first open position to the second open position. The ratio of the length of the substantially flat portion of the reclosable flap in the second open position to the length of the substantially flat portion of the reclosable flap in the first open position may be at least 1.5, for example of at least 2, and such as of at least 2.5. It has been found that this increases accessibility to the contents of the inner package.

The substantially flat portion of the reclosable flap may be adjacent the lid-attachment portion of the reclosable flap and possibly include it. It has been found that this arrangement further contributes to improve reclosable flap repositioning.

The length of the flat, tensioned portion of the reclosable flap may be at least 50% of a distance measured along the reclosable flap between the reclosable flap hinge line and free end of the reclosable flap in the second open position. This has been found to further increase access to the contents of the inner package.

The length of the flat, tensioned portion of the reclosable flap may be of no more than 80% of a distance measured along the reclosable flap between the reclosable flap hinge line and free end of the reclosable flap in the second open position. By limiting the length of the flat, tensioned portion to this value, risk of tearing the inner package in the fully open position is mitigated. This is especially true when the access opening includes a cut line that defines a flap in the inner package that covers the access opening.

When the container has dimensions similar to those of a conventional smoking article container, the length of the flat, tensioned portion of the reclosable flap may be at least around 10 mm, for example of at least around 12 mm. The minimum length of the flat, tensioned portion may correspond to the length of the reclosable flap that is in contact with the first lid panel, which may be at least around 6 mm; this may correspond to the minimum gluing area. In the second open position the length of the flat, tensioned portion of the reclosable flap may be at least around 20 mm, for example of at least around 25 mm, for example of at least around 30 mm, such as of at least around 35 mm.

According to a second aspect of the invention there is provided a method of forming a container for consumer goods, comprising the steps of: providing an inner package of consumer goods comprising an access opening through which consumer goods can be removed, the access opening being covered by a reclosable flap that is movable relative to the inner package about a hinge line; providing a blank and folding it about the inner package for forming an outer housing with a hinged lid such that a lower front edge of the lid abuts a free edge of a box front wall when the lid is in the closed position; attaching a free end of the reclosable flap to the hinged lid so that a ratio between a first distance measured when the hinged lid is in an open position and along a straight line between the lower lid front edge and the hinge line and a second distance along the reclosable flap between the hinge line and its free end is comprised between 70% and 100%.

According to a third aspect of the invention there is provided a container for consumer goods, comprising: an outer housing comprising a box and a hinged lid rotatable between open and closed positions, wherein the hinged lid comprises a first lid panel and a second lid panel, wherein the first lid panel is movable relative to the second lid panel during movement of the lid between the open and closed positions; an inner package of consumer goods within the outer housing comprising an access opening through which consumer goods can be removed; and a reclosable flap movable relative to the inner package about a hinge line and arranged to cover the access opening, a portion of the reclosable flap being attached to the first lid panel; wherein the first lid panel is substantially perpendicular to a lid front wall, when the hinged lid is in a first open position in which a lid top wall is arranged substantially perpendicular to a box back wall.

This minimises the potential for any slack in the reclosable flap when the lid is in the open position. Advantageously this can assist movement of the hinged lid from the open position towards the closed position. In addition, it can improve the positioning of the reclosable flap against the inner package when the hinged lid is moved from the open position to the closed position. In particular, it can improve the positioning of the reclosable flap along the top wall of the inner package to ensure that an effective seal is created and to assist with the preservation of the consumer goods. It has been found that the substantially flat portion of the reclosable flap contributes to ease access to the contents of the inner package.

In some embodiments, the hinge line may be positioned at a top wall of the inner package at a distance from a top, back edge of the inner package that is substantially the same or shorter than a length of the lid-attachment portion of the reclosable flap. Preferably, the ratio between the length of the lid-attachment portion of the reclosable flap and the distance between the hinge line and the top, back edge of the inner package is comprised between 1 and 3. This provides an adequate amount of tension to assist movement of the reclosable flap from the open position towards the closed position while limiting the risk of damaging the inner package or the reclosable flap due to excessive tension in the open position.

To further improve reclosable flap repositioning, the ratio between the length of the lid-attachment portion of the reclosable flap and the distance between the hinge line and the top, back edge of the inner package may be of at least 1.1, for example of at least 1.2, for example of at least 1.3, such as of at least 1.4.

To further reduce the risk of damaging the inner package or the reclosable flap, the ratio between the length of the lid-attachment portion of the reclosable flap and the distance between the hinge line and the top, back edge of the inner package may be of no more than 2.5, for example of no more than 2.2, for example of no more than 2, such as of no more than 1.8.

According to a fourth aspect of the invention there is provided a method of forming a container for consumer goods, comprising the steps of: providing an inner package of consumer goods comprising an access opening through which consumer goods can be removed, the access opening being covered by a reclosable flap that is movable relative to the inner package about a hinge line; providing a blank and folding it about the inner package for forming an outer housing with a hinged lid in a way such that a first lid panel can move relative to a second lid panel when the container is in use; attaching a free end of the reclosable flap to the first lid panel so that the first lid panel is substantially perpendicular to a lid front wall when the hinged lid is in a first open position in which a lid top wall is arranged substantially perpendicular to a box back wall.

According to a fifth aspect of the invention there is provided a container for consumer goods, comprising: an outer housing comprising a hinged lid rotatable between open and closed positions; an inner package of consumer goods within the outer housing comprising an access opening through which consumer goods can be removed, the access opening being covered by a reclosable flap, wherein the reclosable flap is attached to the hinged lid such that a portion of the reclosable flap is substantially coplanar with a planar wall of the hinged lid when the hinged lid moves between the open and closed positions; and an indicium provided at the portion of the reclosable flap that is coplanar with the planar wall.

The reclosable flap can be maintained in a flat or planar configuration by the planar wall of the hinged lid. By providing the indicium on the reclosable flap at this position it is possible to display the indicium without any distortion that might otherwise be introduced by a curved or non-planar surface. Such a distortion may lead to undesirable visual effects for the indicium which is avoided by the present arrangement.

"Indicium" is the singular of the word "indicia" and is used herein to refer to a self-contained design element that provides a representation of information or decoration. An indicium may be a printed or embossed design element that is provided at, on, in or with the reclosable flap. The indicium may include symbols, logos, letters, numbers, images and other marks, as appropriate.

In some embodiments, the indicium may be embedded in the reclosable flap. In other embodiments, the indicium may be provided at an inner surface or an outer surface of the reclosable flap.

The indicium may be provided by a printing medium, by one or more protrusions, by one or more depressions, or a combination thereof. The printing medium may include an ink, a varnish, a lacquer or a combination thereof.

Where the indicium is provided by a printing medium, a protective layer may be arranged to cover the printing medium to prevent egression of compounds therefrom to the consumer goods within the inner package.

In one arrangement the printing medium may be provided at a position on the reclosable flap that is offset from the access opening when the hinged lid is in the closed position. For example, a frame may be provided on the reclosable flap where it overlies the access opening with the hinged lid in the closed position. The frame preferably represents a portion of the reclosable flap where the printing medium is absent and may be of about 2 mm to 5 mm wide. Thus, the frame may create a gap that cannot be traversed by the printing medium in order to inhibit progress of the printing medium towards the access opening.

The hinged lid may comprise a first lid panel which is movable relative to a second lid panel during movement of the hinged lid between the open and closed positions.

The planar wall of the hinged lid may be provided by the first lid panel. In this way, the reclosable flap can be positioned against the first lid panel so that it can be provided in a planar configuration during opening and closing. Additionally, the reclosable flap may be attached to the first lid panel.

The reclosable flap may be provided against the first lid panel, which is a single walled portion of the container. This may simplify construction of the hinged lid and may reduce the need for adhesive that is used in the creation of double-walled assemblies.

The indicium may be at least one of: text, a symbol (e.g. a logo), an image and a pattern. By providing the indicium on a planar portion of the reclosable flap distortion effects are advantageously avoided. The reclosable flap may include indicia on other parts of the reclosable flap, including parts of the reclosable flap that are free to bend. These indicia may include other types of graphic that can be viewed effectively even when they are distorted.

In some embodiments, a portion of the reclosable flap may be held in a substantially flat, tensioned configuration between the hinge line and the hinged lid when the hinged lid is in the open position. This substantially flat portion may include further indicia. Distortion effects are mitigated by providing further indicia in the substantially flat portion of the reclosable flap.

The hinged lid may be connected to the reclosable flap so that there is a first opening stage and a second opening stage. In the first opening stage the hinged lid may be operable to lift a first portion of the reclosable flap away from the inner package so that a two-dimensional area of the reclosable flap is separated from a corresponding two-dimensional area of the inner package at substantially the same time. In the second opening stage the hinged lid may be operable to peel a second portion of the reclosable flap away from the inner package. The two-dimensional area of the reclosable flap may include the indicium so that it is visible during the first opening stage.

According to a sixth aspect of the invention there is provided a reclosable flap for use in a container for consumer goods that comprises an indicium provided at an end portion. The indicium may be provided by a printing medium. The reclosable flap may comprise a protective layer arranged to cover the printing medium to prevent egression of compounds therefrom.

According to a seventh aspect of the invention there is provided a method of forming a container for consumer goods, comprising the steps of: providing an inner package of consumer goods comprising an access opening through which consumer goods can be removed; providing a reclosable flap to cover the access opening of the inner package, wherein the reclosable flap comprises an indicium; providing a blank and folding it about the inner package for forming an outer housing with a hinged lid; and attaching the reclosable flap to the hinged lid such that at least a portion of the reclosable flap is substantially coplanar with a planar wall of the hinged lid when the hinged lid moves between the open and closed positions.

In some embodiments, the step of attaching the reclosable flap to the hinged lid includes attaching the reclosable flap to a first lid panel, and the step of forming the outer housing from the blank includes a step of forming the hinged lid in a way such that the first lid panel can move relative to a second lid panel when the container is in use.

According to an eighth aspect of the invention there is provided a container for consumer goods, comprising: an outer housing comprising a hinged lid rotatable between open and closed positions; an inner package of consumer goods within the outer housing comprising an access opening through which consumer goods can be removed; a reclosable flap arranged to cover the access opening and attached to the hinged lid whereby the reclosable flap moves relative to the access opening during movement of the hinged lid; wherein the reclosable flap carries an indicium in a manner such that the indicium is not visible when the lid is in the closed position and such that the indicium becomes visible during movement of the hinged lid from the closed position towards the open position at an intermediate position in which the reclosable flap covers the periphery of the access opening.

This provides an increased space for communication with the consumer that becomes visible when the consumer opens the container but before the contents are exposed to the atmospheric conditions.

The reclosable flap may be attached to the hinged lid such that a portion of the reclosable flap is substantially coplanar with a planar wall of the hinged lid when the hinged lid moves between the open and closed positions. Preferably, the coplanar portion of the reclosable flap includes at least a portion of the indicium.

According to a ninth aspect of the invention there is provided a method of forming a container for consumer goods, comprising the steps of: providing an inner package of consumer goods comprising an access opening through which consumer goods can be removed; providing a reclosable flap with an indicium and arranging it to cover the access opening of the inner package; providing a blank and folding it about the inner package for forming an outer housing with a hinged lid; and attaching the reclosable flap to the hinged lid so that the indicium is not visible when the lid is in the closed position and that the indicium becomes visible during movement of the hinged lid from the closed position towards the open position at an intermediate position in which the reclosable flap covers the entire periphery of the access opening.

The method may include the additional step of positioning the reclosable flap on the inner package with respect to the access opening such that at least a portion of the indicium is outside the periphery of the access opening.

A tenth aspect of the invention refers to a container for consumer goods, such as smoking articles, having an outer housing with a hinged lid that houses an inner package of consumer goods. The inner package has an access opening through which consumer goods can be removed and that is covered by a reclosable flap. The reclosable flap is attached to a first lid panel that is relatively movable to a second lid panel throughout rotation of the lid between lid open and closed positions. By providing a first lid panel relatively movable to a second lid panel during lid movement between the open and closed positions, and attaching the reclosable flap to the first, movable panel, the reliability of closing the access opening with the reclosable flap is enhanced throughout the life of the container.

The reclosable flap and the first lid panel may be arranged to generate a biasing force on the hinged lid. The biasing force may be generated in favour or against lid movement between the open and closed positions, in one or both senses. The biasing force may be generated to initially oppose lid movement and subsequently favour lid movement.

The reclosable flap and the movable panel may be arranged to generate a biasing force towards the open position when the lid is moved from the closed position towards the open position. By arranging the reclosable flap and the movable panel to generate such biasing force during lid opening, lid opening is eased.

The reclosable flap and the movable panel may be arranged to generate a biasing force towards the closed position when the lid is moved from the closed position towards the open position. By arranging the reclosable flap and the movable panel to generate such biasing force during lid opening, inadvertent lid opening is prevented, particularly when the container is held in a bag or pocket.

The reclosable flap and the movable panel may be arranged to generate a biasing force towards the closed position when the lid is moved from the open position towards the closed position. By arranging the reclosable flap and the movable panel to generate a biasing force towards the closed position during lid closing, lid closing is eased.

The reclosable flap and the movable panel may be arranged to generate a biasing force towards the open position when the lid is moved from the open position towards the closed position. By arranging the reclosable flap and the movable panel to generate such biasing force, a user has to apply an additional force to close the lid. As a result, the user is reassured that the lid is firmly closed.

In some embodiments, the first lid panel may be rotatable about the second lid panel about a rotation axis, in which case a biasing force may be generated by a lever effect. The biasing force may assist lid opening and/or lid closing. Alternatively, or in addition, the biasing force may prevent inadvertent lid opening and/or lid closing.

For example, the first lid panel may be hingedly connected (e.g. by a crease line) to the second lid panel. In a particularly preferred example, an edge of the rotatable panel, which may be opposite the rotation axis of the first lid panel, is in pivoting contact with the inner package throughout a part of the movement of the lid between the open and closed positions. The pivoting contact occurs between the closed position of the lid and an intermediate position, after which the pivoting contact ceases. Preferably, the access opening is covered by the reclosable flap in the intermediate position.

In such configuration, the rotatable panel and the reclosable flap oppose lid opening over the first few degrees of opening, thereby preventing inadvertent lid opening, especially when the container is in a bag or pocket. Further rotation of the lid towards the open position causes the rotatable panel to come into pivoting contact with the inner package and to pivot about the pivoting edge. As a result, the rotatable panel locally pulls the reclosable flap away from the inner package, thereby reducing the necessary force required to pull apart the reclosable flap from the inner package.

The rotatable panel extends the reclosable flap reach in the open position and tensions the reclosable flap during lid closing, thereby ensuring the precise repositioning of the reclosable flap against the inner package. During lid closing, the pivoting edge of the rotatable panel comes into contact with the inner package at a stop motion position. By applying an additional force, the rotatable panel overcomes the stop motion position and pivots about the pivoting edge to the lid closed position without requiring an additional force. Therefore, a user is reassured that the container is positively closed by this tactile feedback and snapping effect.

The first lid panel may have a length, measured from its rotation axis to an opposite edge, of at least 6 mm, for example of at least 7 mm. This aids attachment of the reclosable flap to the first lid panel, especially when a permanent adhesive is used for that purpose.

The first lid panel may have a length, measured from its rotation axis to an opposite edge, of no more than 12 mm, for example of no more than 10 mm, such as of about 9 mm. By limiting the length of the first lid panel, risk of damaging the panel during lid opening and closing (e.g. by bending) is reduced, thereby broadening material selection options. By adding certain features from other aspects of the invention, it is possible to increase the length of the first lid panel without increasing the risk of damaging it during lid opening.

In some embodiments the relative movement of the movable panel is rotation. In a preferred embodiment, the first lid panel rotates about an axis parallel to the axis of rotation of the lid. In other embodiments, though, the relative movement of the movable panel is translation, for example, in a direction substantially perpendicular to the inner package. In yet further embodiments, the relative movement of the movable panel is a combination of rotation and translation.

In some embodiments, the first lid panel may be initially fixed relative to the second lid panel. By providing an initial relative fixation of the first and second lid panels, the first lid panel is not relatively movable to the second lid panel during manufacturing and only becomes movable once the one or more breakable connections are ruptured, which occurs when the container is opened for the first time as the reclosable flap is attached to the first lid panel. This eases attachment of the reclosable flap to the first lid panel during manufacturing and prevents possible machine jams.

For example, the first lid panel may be relatively movable to the second lid panel after a breakable connection has been broken. In one particularly preferred example, the first lid panel is connected by one or more breakable connections to a third lid panel.

The one or more breakable or rupturable connections may be formed in different manners. For example, the first and third lid panels may be connected by a line of weakness, which can be continuous or discontinuous. In some examples, the first and third lid panels are connected by a row of perforations. In other examples, the first and third lid panels are connected by a score line with a suitable depth. For example, the depth of the score line can be of about 80% of the thickness of the first and third lid panels, such as of about 90% of the thickness of the first and third lid panels. In yet another example, the first lid panel is partially die cut from the third lid panel, leaving one or more connecting notches.

In a preferred embodiment, in the closed position, the reclosable flap and the inner package are provided next to one another around the periphery of the access opening at a coupling region, the coupling region having a resealable adhesive to releasably affix the inner package and the reclosable flap.

An eleventh aspect of the invention refers to a blank for forming an outer housing of the container of the present invention. The blank has box and lid portions, the lid portion having first, second and third panels. The first panel is hingedly connected to the second panel and is also connected to the third panel by one or more breakable connections. By providing a hinged connection between the first and second panels and one or more breakable connections between the first and third panels, the first panel can be mobilized by breaking the one or more connections with the third panel and become rotatable to the second panel. This eases attachment of the reclosable flap to the first lid panel during manufacturing and prevents possible machine jams.

A twelfth aspect of the invention refers to a blank for forming an outer housing of the container of the present invention. The blank has box and lid portions, the lid portion having first, second and third panels. The second panel is connected to the first and third panels, the first panel being surrounded by the second and third panels.

According to a thirteenth aspect, the invention also provides a method of forming a container for consumer goods. The method includes the steps of providing an inner package of consumer goods comprising an access opening through which consumer goods can be removed, the access opening being covered by a reclosable flap; providing a blank and folding it about the inner package for forming an outer housing with a hinged lid; and attaching the reclosable flap to a first lid panel of the hinged lid. The step of forming the outer housing from the blank comprises a step of forming the hinged lid in a way such that the first lid panel can move relative to a second lid panel when the container is in use.

In some embodiments, the step of forming the hinged lid comprises not applying permanent adhesive to fix the first lid panel to any other lid panel. By not providing permanent adhesive to fix the first lid panel to any other lid panel, the first lid panel is movable with respect to the second lid panel.

In some embodiments, the step of forming the hinged lid comprises folding the first lid panel against the second lid panel without permanently adhering the first and second lid panels. In other words, the first lid panel may be folded against the second lid panel, but no permanent adhesive may be provided between the first and second lid panels.

According to a fourteenth aspect of the invention there is provided a container for consumer goods, comprising: an outer housing comprising a hinged lid rotatable between open and closed positions; an inner package of consumer goods within the outer housing comprising an access opening through which consumer goods can be removed, the access opening being covered by a reclosable flap; wherein the hinged lid is connected to the reclosable flap so that there is a first opening stage and a second opening stage, and wherein in the first opening stage the hinged lid is operable to lift a first portion of the reclosable flap away from the inner package so that a two-dimensional area of the reclosable flap is separated from a corresponding two-dimensional area of the inner package at substantially the same time, and wherein in the second opening stage the hinged lid is operable to peel a second portion of the reclosable flap away from the inner package.

Preferably the hinged lid comprises a first lid panel and a second lid panel, the first lid panel being relatively movable to the second lid panel. The reclosable flap may be attached to the first lid panel.

In the first opening stage, the reclosable flap may be arranged to pivot away from the inner package together with the first lid panel so that the two-dimensional area of the reclosable flap is separated from the corresponding two-dimensional area of the inner package at substantially the same time.

In the second opening stage, the hinged lid may be arranged to apply a tension to the reclosable flap in order to peel the second portion of the reclosable flap away from the inner package. However, in the first opening stage, substantially no tension may be applied to the reclosable flap.

According to a fifteenth aspect of the invention there is provided a container for consumer goods, comprising: an outer housing comprising a hinged lid rotatable between open and closed positions; an inner package of consumer goods within the outer housing comprising an access opening through which consumer goods can be removed, the access opening being covered by a reclosable flap; wherein the hinged lid is connected to the reclosable flap so that there is a first closing stage and a second closing stage, and wherein in the first closing stage the hinged lid is operable to roll a second portion of the reclosable flap onto the inner package, and wherein in the second closing stage the hinged lid is operable to lower a first portion of the reclosable flap onto the inner package so that a two-dimensional area of the reclosable flap contacts a corresponding two-dimensional area of the inner package at substantially the same time.

Preferably the hinged lid comprises a first lid panel and a second lid panel, the first lid panel being relatively movable to the second lid panel. The reclosable flap may be attached to the first lid panel.

In the second closing stage, the reclosable flap may be arranged to pivot towards the inner package together with the first lid panel so that the two-dimensional area of the reclosable flap is brought into contact with the corresponding two-dimensional area of the inner package at substantially the same time.

In the first closing stage, the hinged lid may be arranged to apply a tension to the reclosable flap in order to roll the second portion of the reclosable flap over the inner package. However, in the second closing stage, substantially no tension may be applied to the reclosable flap.

According to a sixteenth aspect of the invention there is provided a method of opening a container for consumer goods, wherein the container comprises an outer housing comprising a hinged lid rotatable between open and closed positions, and an inner package of consumer goods within the outer housing comprising an access opening through which consumer goods can be removed, the access opening being covered by a reclosable flap which is connected to the hinged lid, wherein the method comprises: a first opening stage in which the hinged lid lifts a first portion of the reclosable flap away from the inner package so that a two-dimensional area of the reclosable flap is separated from a corresponding two-dimensional area of the inner package at substantially the same time; and a second opening stage in which the hinged lid peels a second portion of the reclosable flap away from the inner package.

According to a seventeenth aspect of the invention there is provided a method of closing a container for consumer goods, wherein the container comprises an outer housing comprising a hinged lid rotatable between open and closed positions and an inner package of consumer goods within the outer housing comprising an access opening through which consumer goods can be removed, the access opening being covered by a reclosable flap which is connected to the hinged lid, wherein the method comprises: a first closing stage in which the hinged lid rolls a second portion of the reclosable flap onto the inner package; and a second closing stage in which hinged lid lowers a first portion of the reclosable flap onto the inner package so that a two-dimensional area of the reclosable flap contacts a corresponding two-dimensional area of the inner package at substantially the same time.

According to an eighteenth aspect of the invention there is provided a container for consumer goods, comprising: an outer housing comprising a box and a hinged lid rotatable between open and closed positions, wherein the hinged lid comprises a first lid panel and a second lid panel, wherein the first lid panel is movable relative to the second lid panel during movement of the hinged lid between the open and closed positions; an inner package of consumer goods within the box comprising an access opening through which consumer goods can be removed and that is provided at least at a portion of top and front walls of the inner package; and a reclosable flap arranged to cover the access opening and attached to the first lid panel; wherein a ratio between a length of the first lid panel to a distance between a top, front edge of the inner package and a top, front edge of the box is at least 0.3.

In this way, the first lid panel can brush the top surface as the hinged lid is closed. This can control movement of the first lid panel to ensure that it is in the correct position for attachment to the reclosable flap and to mitigate the risk of machine jam during outer housing formation. In particular, when a fluid adhesive is used, the contact between the first lid panel and the top surface can prevent the first lid panel from wiping the fluid adhesive away from the gluing region.

During the closing operation the first lid panel may brush the top surface of the reclosable flap and then brush the front surface of the inner package. This may represent two discrete contacts that are separated in time. Alternatively, there may be continuous contact between the first lid panel and the reclosable flap which includes the brushing contact on the top surface and the brushing contact on the front surface.

Preferably the first lid panel is configured to come into contact with a top, front edge of the reclosable flap as the hinged lid is moved from the open position towards the closed position.

In some embodiments, the first lid panel is configured to also come into contact with a top surface of the inner package as the hinged lid is moved from the open position towards the closed position prior to attachment of the reclosable flap to the first lid panel. Preferably, the first lid panel is configured to come into contact with a top, front edge of the inner package as the hinged lid is moved from the open position towards the closed position.

As used herein, the top, front edge is generally considered as part of the top surface.

Preferably the first lid panel rotates about a rotation axis relatively to the second lid panel during movement of the lid between the open and closed positions. In a preferred embodiment, the first lid panel is hingedly connected to the second lid panel.

The contact between the first lid panel and the top surface preferably rotates the first lid panel towards the second lid panel. This may reduce the risk that the first lid panel rotates away from the second lid panel into an undesired configuration during manufacture.

In some embodiments, in the closed position, the reclosable flap and the inner package are provided next to one another around the periphery of the access opening at a coupling region, which has a resealable adhesive to releasably affix the inner package and the reclosable flap. This helps to mitigate an undesirable "lid smiling" effect whereby the hinged lid is slightly open in the closed position.

The first lid panel may include an edge that is configured to pivotally contact the inner package during movement of the lid between the open and closed positions, after attachment of the reclosable flap to the first lid panel.

By providing a ratio between a length of the first lid panel and a distance between a top, front edge of the inner package and a top, front edge of the box that is no more than 0.5, it is possible to mitigate any undesirable lid smiling. This ratio may be of no more than 0.45, for example of no more than 0.40, to further mitigate any possible lid smiling.

By providing a ratio between a length of the first lid panel and a distance between a top, front edge of the inner package and a top, front edge of the box that is at least 0.3, for example of at least 0.35, movement of the first lid panel during manufacturing is further controlled and risk of machine jam is further reduced.

An adhesive may be provided for attaching the reclosable flap to the first lid panel. The adhesive may be in liquid form initially and it may be provided on the reclosable flap. The present arrangement advantageously reduces the likelihood that the first lid panel moves into an undesirable configuration that sweeps liquid adhesive off the reclosable flap. This would be undesirable firstly because it reduces the likelihood that an effective bond can be created between the reclosable flap and the first lid panel and secondly because it would direct liquid adhesive onto other surfaces of the container.

According to a nineteenth aspect of the invention there is provided a blank for forming an outer housing of the container of the present invention. The blank comprises a box portion and a lid portion, the lid portion comprising a first panel hingedly connected to a second panel, wherein a ratio between a width of the first panel to a width of the second panel is comprised between 0.5 and 1.0. It has been found that such ratio contributes to obtaining a consistent brushing of the top surface of the reclosable flap and also that reclosable flap attachment is improved.

Preferably, the ratio is of at least 0.6, for example of at least 0.7, such as of at least 0.8. These values further contribute to the previous effect.

A ratio between a length of the first panel to a length of the second panel may be no more than 0.5, for example no more than 0.45, such as no more than 0.40. This mitigates any possible lid smiling.

The ratio between the length of the first panel to the length of the second panel may be at least 0.3, for example at least 0.35. This assists in controlling movement of the first lid panel during manufacturing and reduces risk of machine jam.

In some embodiments, the lid portion further comprises a third panel that is hingedly connected to the box portion. A ratio between a length of the first panel to a length of the third panel may be no more than 2, for example no more than 1.75, such as no more than 1.5. These values contribute to mitigate any possible lid smiling.

The ratio between the length of the first panel to the length of the third panel may be at least 1.2, for example at least 1.25, such as at least 1.3. This assists in controlling movement of the first lid panel during manufacturing and reduces risk of machine jam.

According to a twentieth aspect of the invention there is provided a method of forming a container for consumer goods, comprising the steps of: providing an inner package of consumer goods comprising an access opening through which consumer goods can be removed, the access opening being covered by a reclosable flap; providing a blank and folding it about the inner package for forming an outer housing with a hinged lid and forming the hinged lid in a way such that the first lid panel can move relative to a second lid panel when the container is in use; moving the second lid panel towards the reclosable flap so that the first lid panel comes into contact with a top surface of the reclosable flap, for example, during or after the step of folding the blank; and attaching the reclosable flap to the first lid panel.

According to a twenty-first aspect of the present invention there is provided a container for consumer goods, comprising: an outer housing comprising a hinged lid rotatable between open and closed positions, wherein the hinged lid comprises a first lid panel and a second lid panel, the first lid panel being movable relative to the second lid panel during movement of the lid between the open and closed positions;

an inner package of consumer goods within the outer housing comprising an access opening through which consumer goods can be removed; and a reclosable flap arranged to cover the access opening, wherein, in the closed position, an inner surface of the reclosable flap forms an overlap region with an outer surface of the inner package that extends around the periphery of the access opening, the overlap region comprising a non-adhering region; wherein an outer surface of the reclosable flap is attached to the first lid panel at an attachment region that is provided opposite the non-adhering region; wherein the non-adhering region has a surface that is at least the same size as the surface of the attachment region.

By attaching the outer surface of the reclosable flap to the first lid panel opposite the non-adhering region and providing a surface of the non-adhering region that is at least the same size as the surface of the attachment region, relative movement of the first lid panel to the second lid panel during lid movement is eased. This results in an easier opening and closing of the lid throughout the life of the container, which is especially noticeable in the first opening of the container.

The non-adhering region in the overlap region advantageously has a surface or size that is substantially the same as the surface or size of the attachment region, but, preferably, the surface or size of the non-adhering region is larger than the surface or size of the attachment region. By providing a non-adhering region larger than the attachment region, manufacturing is simplified as the manufacturing tolerances involved in the attachment of the reclosable flap to the first lid panel are less critical for a correct functioning of the container.

In embodiments where the surface or size of the non-adhering region is larger than the surface or size of the attachment region, the non-adhering region, in the closed position, may extend away from the attachment region, for example, by at least 1 mm, such as by at least 3 mm, and, preferably, towards the access opening. By providing a non-adhering region that, in the closed position, extends away from the attachment region towards the access opening, relative movement of the first lid panel to the second lid panel during lid movement is yet further eased.

In a preferred embodiment, the attachment region is provided at a free end of the reclosable flap. By providing the attachment region at the free end of the reclosable flap, pack construction is simplified and the length of the reclosable flap is optimised.

For some embodiments, when the hinged lid is moved from the closed position to the open position, a pivoting movement may be provided about the first lid panel whereby the first lid panel pivots against the inner package along a pivot line. The non-adhering region preferably includes the pivot line. The absence of any adhesive effect in this region can promote the ease with which pivoting movement can occur as it enables the reclosable flap to slide against the inner package. This reduces the stress exerted on the inner package and, as a result, the length of the first lid panel may be selected to ease attachment of the reclosable flap to it, and to adjust the closing force of the pack.

In practice the position of the pivot line may be movable as the reclosable flap may slide against the inner package. Preferably the non-adhering region is provided for all positions of the pivot line.

For example, the first lid panel may be hingedly connected (e.g. by a crease line) to the second lid panel. In a particularly preferred example, an edge of the rotatable panel, which may be opposite the rotation axis of the first lid panel, is in pivoting contact with the inner package throughout a part of the movement of the lid between the open and closed positions. The pivoting contact occurs between the closed position of the lid and an intermediate position, after which the pivoting contact ceases. Preferably, the access opening is covered by the reclosable flap in the intermediate position.

The first lid panel may have a length, measured from its rotation axis to an opposite edge, of at least 6 mm, for example of at least 7 mm, such as of at least 8 mm. This aids attachment of the reclosable flap to the first lid panel, especially when a permanent adhesive, applied in fluid state, is used for that purpose.

The first lid panel may have a length, measured from its rotation axis to an opposite edge, of no more than 15 mm, for example of no more than 13 mm, such as of about 10 or 11 mm. By limiting the length of the first lid panel, risk of damaging the panel during lid opening and closing (e.g. by bending) is reduced, thereby broadening material selection options.

The overlap region may further comprise an adhering region to releasably affix the outer surface of the inner package to the inner surface of the reclosable flap. In the closed position, the adhering region includes at least a portion of the periphery of the access opening.

In some embodiments, in the closed position, the non-adhering region does not extend as far as the access opening and the adhering region extends around the entire periphery of the access opening. This provides a reclosable seal for the consumer goods that can improve preservation of tobacco products in particular atmospheric conditions by limiting their exposure to the atmospheric conditions.

In other embodiments, in the closed position, the non-adhering region may include a portion of the periphery of the access opening. This provides a breathable seal for the consumer products as oxygen exchange is permitted between the external environment and the interior of the inner package, even when the reclosable flap is in the closed position. This is possible because the non-adhering region, which includes a portion of the periphery of the access opening, is non-adhering. Therefore, the reclosable flap is generally not attached to the inner package in the non-adhering region. The reclosable flap and the inner package may be in contact or in close contact and there may be microscopic gaps between the two that can allow for fluid communication between the interior and exterior of the inner package. This can actually improve preservation of tobacco products in particular atmospheric conditions.

The non-adhering region may preferably extend from an edge of the access opening to an exterior edge of the overlap region such that the fluid communication is provided for.

In one arrangement, the adhering region may include at least a portion of a top wall of the inner package. It has been found that this improves positioning of the reclosable flap against the inner package. The adhering region may additionally or alternatively include a portion of a front wall of the inner package. Thus, the reclosable flap can wrap around the front, top shoulder of the inner package, including the front, top edge of the inner package, and adhere to the inner package. It has been found that this can improves positioning of the reclosable flap during lid closing.

Preferably the adhering region includes a portion of the front wall that extends away from a front, top edge of the inner package. For example, the first adhering region may extend away from the front, top edge of the inner package by at least 5 mm in a direction substantially perpendicular to the front, top edge of the inner package.

In some embodiments, the overlap region may comprise a second non-adhering region, with the adhering region located between the first and second non-adhering regions.

The reclosable flap may be connected to the inner package so as to be movable relative to the inner package about a hinge line and the second non-adhering region may be provided adjacent the hinge line of the reclosable flap. It has been found that tobacco crumbs preferentially gather at the pinch point between the reclosable flap and the inner package that is created by the hinge line. In some arrangements tobacco crumbs may be guided towards the hinge line by the movement of the reclosable flap. By providing an adhesive-free region adjacent the hinge line it is possible to reduce the number of tobacco crumbs that adhere to the reclosable flap. This can provide an additional advantage by allowing the reclosable flap to open more fully in order to improve access to the smoking articles in the inner package.

In some configurations, the second non-adhering region has a dimension, extending along the reclosable flap and away from the hinge line, that is at least around 4 mm, for example of at least around 6 mm, such as at least around 8 mm. It has been observed that the major portion of tobacco crumbs that adhere to prior art containers have an average size of less than around 3 mm. These containers sometimes present some tobacco crumbs with an average size of between around 3 mm and 5 mm. Isolated larger tobacco crumbs with an average size of up to around 1 mm are rarely visible as opening and closing the reclosable flap either rubs off the larger tobacco crumbs or breaks them into smaller particles. Therefore, by providing a second non-adhering region with a dimension of at least around 4 mm, accumulation of tobacco crumbs at the second overlap region throughout container life is reduced as it is less likely that tobacco crumbs adhere at the second overlap region and a portion of those that do adhere are broken into smaller particles throughout use of the container and transported towards the second non-adhering region, where they eventually fall off. Enlarging the second non-adhering region further reduces the accumulation of tobacco crumbs.

The dimension may be substantially perpendicular to the hinge line, along the reclosable flap. In some embodiments the dimension may be bent. This may occur when the hinge line is on a back wall of the inner package, and the second non-adhering region extends partially along the back wall and partially along the top wall.

The non-adhering region may be provided in a strip that is substantially parallel to the hinge line. In another arrangement a portion of the overlap region may be provided with a reduced adhesiveness and positioned at the other side of the access opening to the hinge line of the reclosable flap. For example, the overlap region may comprise the first non-adhering region at a free end of the reclosable flap, a second non-adhering region adjacent the hinge line of the reclosable flap, a first adhering region adjacent the second non-adhering region, and a region with reduced adhesiveness between the first adhering and non-adhering regions.

The hinge line may be provided at a top wall of the inner package. In other arrangements the hinge line may be provided at a back wall of the inner package, adjacent the hinged lid. The reclosable flap may be connected to the inner package at the top wall and/or the back wall.

The inner package may have a top wall and a front wall, and the adhering region may be provided at least partially at the top wall and at least partially at the front wall. It has been found advantageous to provide resealable adhesive on the top wall and the front wall because it can help to position the reclosable flap in the desired position when closed. In a closing operation, adhesion may occur first on the top wall, which can help the reclosable flap to wrap around the upper, front edge and adhere against the front wall.

The adhering region may have a length, extending along the inner package and away from the front wall along the top wall, which is at least around 4 mm, such as at least around 6 mm, for example of at least around 8 mm. In some embodiments, the first adhering region has a length of at least around 12 mm.

The adhering region may have a length at the top wall which is at least around 25% of the depth of the top wall of the inner package. In another arrangement the adhering region may have a length at the top wall which is at least around 25% of the distance between the front, upper edge and the hinge line of the reclosable flap.

The overlap region may comprise a plurality of adhering regions and a plurality of non-adhering regions, where the adhering regions are intercalated between the non-adhering regions. Preferably, the adhering and non-adhering regions are provided as strips, which are preferably substantially parallel to the hinge line.

According to a twenty-second aspect of the invention there is provided a method of forming a container for consumer goods, comprising the steps of: providing an inner package of consumer goods comprising an access opening through which consumer goods can be removed; providing a reclosable flap to cover the access opening of the inner package, wherein, in the closed position, an inner surface of the reclosable flap forms an overlap region with an outer surface of the inner package, wherein the overlap region comprises a non-adhering region; providing a blank and folding it about the inner package for forming an outer housing with a hinged lid; attaching an outer surface of the reclosable flap to a first lid panel of the hinged lid so that the reclosable flap overlaps the first lid panel within the non-adhering region; wherein the step of forming the outer housing from the blank comprises a step of forming the hinged lid in a way such that the first lid panel can move relative to a second lid panel when the container is in use.

The method may involve positioning the reclosable flap on the inner package with respect to the access opening such that the non-adhering region includes a pre-defined portion of the periphery of the access opening. This may be achieved by referencing the non-adhering region of the overlap region against the access opening. This can ensure that the reclosable flap is positioned correctly so that it can seal the contents of the inner package effectively.

Many modifications and variations of the described containers fall within the scope of the invention. In particular, features from any aspect of the invention equally may be applied to any another aspect of the invention.

Containers according to any aspect of the invention may also include an inner frame, for example a U-shaped inner frame having a front wall and a pair of opposed side walls. In some embodiments the inner frame may be provided inside the inner package surrounding a portion of the consumer goods. In other embodiments, the inner frame is provided between the outer housing and the inner package. By providing an inner frame, the rigidity of the container is increased, which further contributes to increase the reliability of the closing of the access opening.

Inner packages according to any aspect of the invention may be formed of metal foil, metallised paper or a plastics film. The inner package material may be formed as a laminate of a metallised plastics film, such as metallised polyethylene film or metallised polypropylene, and a liner material. In addition, the inner package material may be provided with a print-receptive top coating.

In some embodiments, the non-adhering region may be substantially free of adhesive to ensure that the inner package and the reclosable flap do not adhere. For example, the overlap region may be provided with resealable adhesive in the adhering region, while the non-adhering region may be substantially free of adhesive. In a preferred embodiment, the reclosable flap may be provided with a resealable adhesive in the adhering region and may be substantially free of adhesive in the non-adhering region(s), while the surface of the inner package is substantially free of adhesive in both the adhering and non-adhering regions.

In other embodiments, the non-adhering region(s) may be neutralised to ensure that it does not adhere the inner package and the reclosable flap. For example, the overlap region may be initially provided with resealable adhesive in both the adhering and non-adhering regions, but the resealable adhesive in the non-adhering region(s) may then be neutralised to remove the adhesiveness of the adhesive. In a preferred embodiment, the reclosable flap is initially provided with resealable adhesive in both the adhering and non-adhering regions, but then the resealable adhesive is neutralised in the non-adhering region(s). In the preferred embodiment, the surface of the inner package is substantially free of adhesive.

In another example, one surface of the overlap region may be provided with resealable adhesive in both the adhering and non-adhering regions and the other surface of the second overlap region may be provided with a release agent in the non-adhering region(s) such that the resealable adhesive does not adhere in the non-adhering region(s). In a preferred embodiment, the reclosable flap is provided with resealable adhesive in both the adhering and non-adhering regions and the surface of the inner package is provided with a release agent in the non-adhering region. The release agent may be a silicone-based release agent. Preferably, the release agent is in the form of a printable composition, such as an ink.

Reclosable flaps according to any aspect of the invention may be connected to the inner package so as to be movable relative to the inner package about a hinge line. In some embodiments, the reclosable flap may be attached to the outer surface of the inner package so that it covers the access opening in the inner package. In such case, the reclosable flap preferably extends beyond the periphery of the access opening.

In other embodiments, the reclosable flap is defined by a cut line or a line of weakness in the outer surface of the inner package that covers the access opening. In such case, an adhesive label may be adhered to the inner surface of the inner package in a portion where the reclosable flap overlies the adhesive label and the access opening may be provided in the adhesive label, for example, by a cut-out or a line of weakness, or a cut line, that defines a flap that covers the access opening.

The reclosable flaps of any aspect of the present invention may be formed of, for example, high density polyethylene (HDPE), low density polyethylene (LDPE), biaxially oriented polypropylene (BOPP), nylon, polystyrene, cellulosic films, such as cellophane® and cellulose acetate, polyvinylchloride (PVC), paper, polyethylene terephthalate (PET) and mixtures of the foregoing.

Preferably, the consumer goods are smoking articles. However, the container may be suitable for a variety of consumer goods, such as confectionary, dry foodstuff, or the like.

The container is preferably a rectangular parallelepiped comprising two wider walls spaced apart by two narrower walls with right-angled longitudinal and right-angled transverse edges. Alternatively, the container may comprise one or more rounded longitudinal edges, rounded transverse edges, bevelled longitudinal edges or bevelled transverse edges, or combinations thereof.

The container may be formed from any suitable materials including, but not limited to, cardboard, paperboard, plastic, metal, or combinations thereof. Preferably, the outer housing is formed from one or more folded laminar cardboard blanks and, preferably, the cardboard has a weight of between about 230 $g/m^2$ and about 350 $g/m^2$. In some examples, the cardboard has a weight of at least 250 $g/m^2$, for example of about 270 $g/m^2$.

When the container has dimensions similar to those of a conventional smoking article container, the lid is hinged preferably at a distance of the top, back edge of the container of 12 mm or less, such as 10 mm or less, for example of about 8 mm.

Once filled, containers according to the invention may be shrink wrapped or otherwise over wrapped with a transparent polymeric film of, for example, high or low density polyethylene, polypropylene, oriented polypropylene, polyvinylidene chloride, cellulose film, or combinations thereof in a conventional manner. Where containers according to the invention are over wrapped, the over wrapper may include one or more tear tapes. In addition, the over wrapper may be printed with images, consumer information or other data.

As used herein, the terms "front", "back", "upper", "lower", "top", "bottom" and "side" refer to the relative positions of portions of containers according to the invention and components thereof when the container is in an upright position with the lid of the outer housing in the closed position and the hinge line at the back of the container.

The term "longitudinal" refers to a direction from bottom to top or vice versa. The term "transverse" refers to a direction perpendicular to the longitudinal direction. The term "length" is used throughout the specification to refer to the longitudinal extension of a panel of a blank or a wall of a container. The term "width" is used throughout the specification to refer to the transverse extension of a panel of a blank or a wall of a container.

The term "inner surface" is used throughout the specification to refer to the surface of a component of the assembled container that is facing towards the interior of the container, for example towards the consumer goods, when the container is in the closed position. The term "outer surface" is used throughout the specification to refer to the surface of a component of the container that is facing towards the exterior of the container.

The term "permanent adhesive" is used throughout the present specification to refer to a generally high tack adhesive capable of forming a reliable and secure connection between two substrates such that the two substrates do not become substantially separated during the normal and intended use of the container. In fact, separation of two substrates affixed to one another by means of a permanent adhesive would typically cause some undesirable damage (e.g. tearing) to one or both substrates involved or leave an undesirable residue.

The term "resealable adhesive" is used throughout the present specification to describe a generally low tack, removable adhesive capable of forming connection between two substrates such that the two substrates can be repeatedly separated and re-attached to one another.

The term "activatable" is used herein to describe an adhesive element that is supplied to the consumer in a non-tacky state, such that it is unable to stick to another component of the container. An activatable adhesive element requires some form of activation on the part of the consumer to be brought into a tacky state for application to another component.

BRIEF DESCRIPTION OF THE DRAWINGS

The invention(s) will be further described, by way of example only, with reference to the accompanying drawings in which:

FIG. 3A is a perspective view and FIG. 3B is a front view;

DETAILED DESCRIPTION

Figure 1:
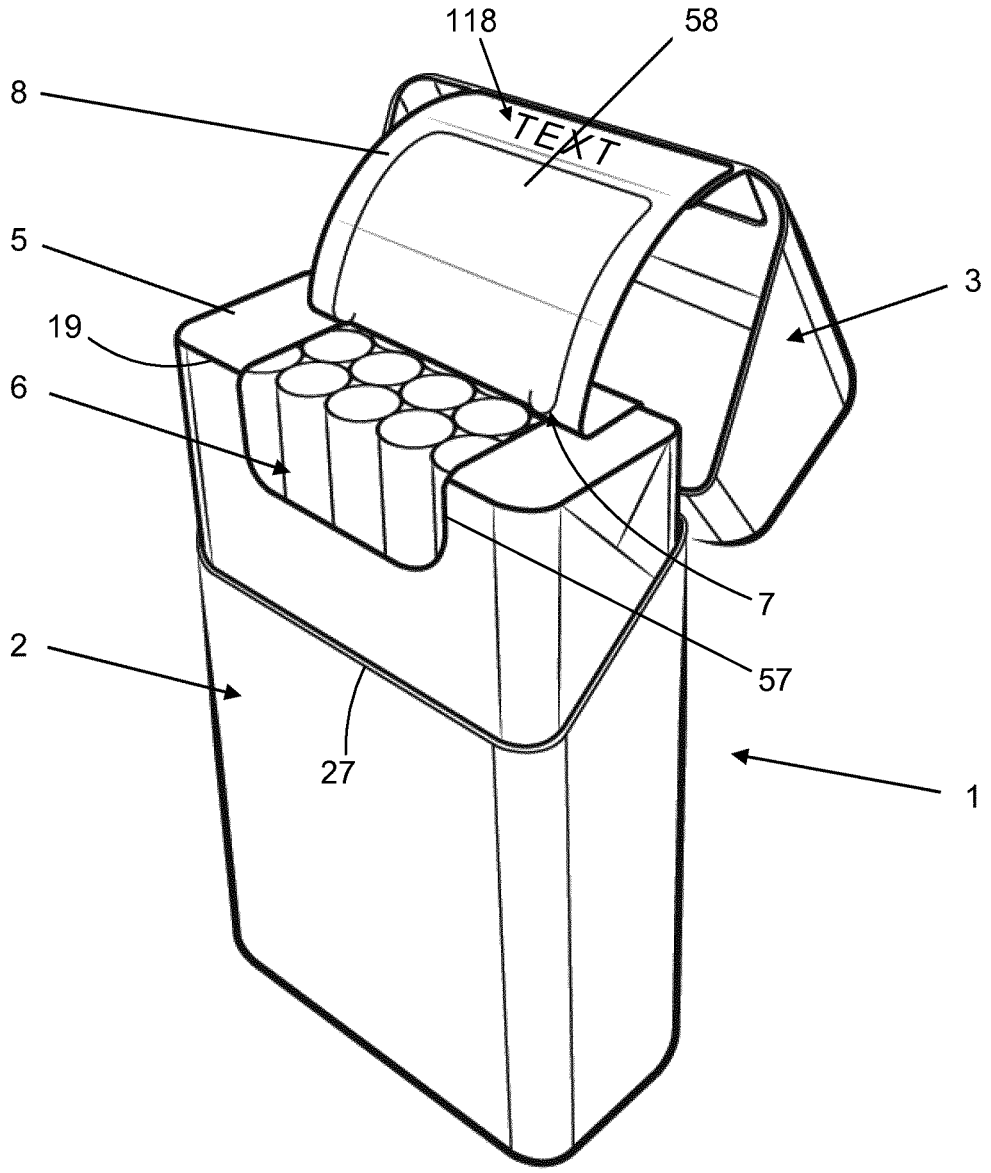
FIG. 1 shows a perspective view of a container in a first embodiment of the invention in a lid open position.

The hinge lid container 1 shown in FIG. 1 comprises a box 2 and a lid 3 that is hinged to the box 2 along a hinge line. FIG. 1 shows the container 1 with the lid 3 in an open position. A bundle of cigarettes, wrapped in an inner package 5, is housed in the box 2 of the container 1.

The box 2 has a box front wall, a box left side wall, a box right side wall, a box back wall, and a box bottom wall. The upper side of the box 2 is open, to provide an upper opening through which the cigarettes can be removed.

The lid 3 has a lid front wall, a lid left side wall, a lid right side wall, a lid back wall and a lid top wall. When the container 1 is closed, the free edges of the walls of the lid 3 abut the free edges of the walls of the box 2 along a line of abutment. In the closed position, the walls of the lid 3 therefore form extensions of the corresponding walls of the box 2 to define the walls of the outer housing 1.

The inner package 5 includes an access opening 6 through which the cigarettes can be removed. When the inner package 5 of cigarettes is in place within the box 2, the access opening 6 is positioned at the open, upper end of the box 2. The access opening 6 includes a cut line 57 that defines a flap 58 that covers the access opening 6. The flap 58 is movable to cover and uncover the access opening 6 and thus negate or allow access to the cigarettes. A line of weakness may be provided instead of the cut line 57 so that the flap 58 separates from the inner package 5 only upon first opening of the container 1. Alternatively, the access opening 6 is a cut-out 59 (see FIG. 19B).

An inner frame 4 (formed from a blank shown in FIG. 20) is mounted within the inner package 5 of the container 1. The inner frame 4 comprises an inner frame front wall, an inner frame left side wall and an inner frame right side wall which are positioned proximate the inner surface of the inner package front wall, inner package left side wall and inner package right side wall, respectively. The inner frame 4 may be optionally connected, for example, glued, to the inner package 5. The inner frame front wall includes a rectangular cut-out at the top free edge, in order to facilitate removal of the cigarettes from the box 2. The rectangular cut-out substantially corresponds to a front wall portion of the access opening 6 in the inner package 5. The walls of the inner frame extend above the upper edges of the box 2.

A reclosable flap 8 is attached to the outer surface of the inner package 5 so that it covers the access opening 6 in the inner package 5. The reclosable flap 8 is affixed to the inner package 5 at the upper, back edge of the inner package 5, which provides a hinge line 7 about which the reclosable flap 8 can be pivoted to open and close the access opening 6. In other words, the reclosable flap 8 is attached to the inner package 5 so that a portion of the reclosable flap 8 is movable relative to the inner package 5 during lid 3 movement, while another portion of the reclosable flap 8 is not movable during lid 3 movement. The reclosable flap 8 extends beyond the periphery 57 of the access opening and is also affixed to the inner package flap 58.

The reclosable flap 8 in this embodiment is a self-adhesive label. The label 8 includes a resealable adhesive on its inner surface, which overlies a portion of the inner package 5 substantially around the periphery 57 of the access opening 6. When the lid 3 is in the closed position the resealable adhesive affixes the adhesive label 8 to the inner package 5.

The resealable adhesive may also be used to affix the inner package flap 58, although it is preferred to use a permanent adhesive to prevent the inner package flap 58 from peeling off the label 8 after a number of openings. The resealable adhesive may be a pressure sensitive adhesive. The permanent adhesive may be a UV-cured pressure sensitive adhesive.

Figure 5:
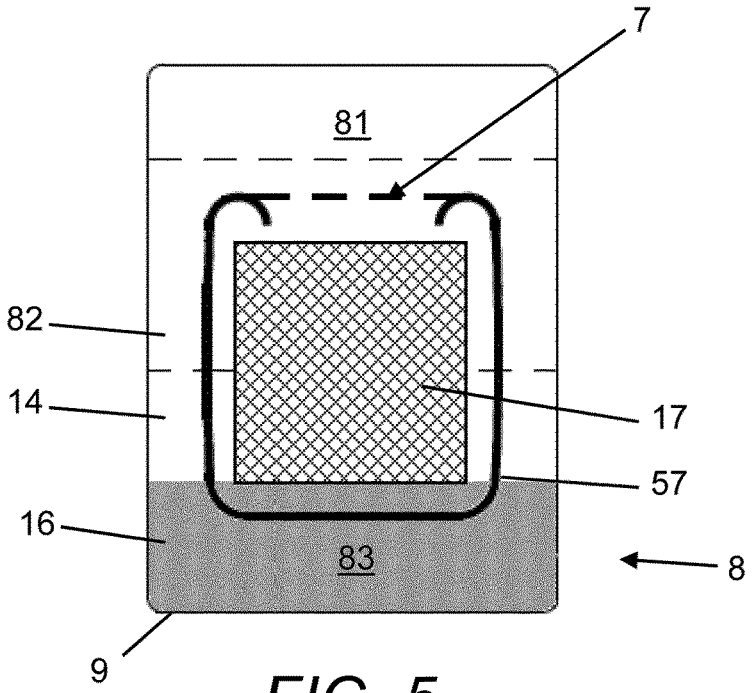
FIG. 5 shows a plan view of a reclosable flap of the container in the second embodiment of the invention.

The permanent adhesive may be provided inside a frame of resealable adhesive within the periphery 57 of the access opening 6, as shown in FIG. 5, where the permanent adhesive is provided in an area 17 within the periphery 57 of the access opening 6. The frame may have a minimum separation with the periphery 57 of the access opening 6 of about 1 to 5 mm, for example of about 2 to 3 mm. By providing a frame of resealable adhesive around the permanent adhesive area 17 inside the periphery 57 of the access opening 6, it is possible to mitigate the inner package flap 58 from peeling off the label 8 after a number of openings while absorbing label 8 positioning tolerances over the inner package flap 58 that could cause the label 8 to permanently adhere to the inner package 5 inside and outside the access opening 6, thus, preventing opening the inner package 5 without damaging it. Although only represented in this embodiment, the permanent adhesive area 17 may be optionally present in any embodiment having an inner package flap 58.

In an alternative embodiment where the access opening 6 is a cut-out 59, the label 8 is substantially free of adhesive within the periphery 57 of the access opening 6.

Figure 2:
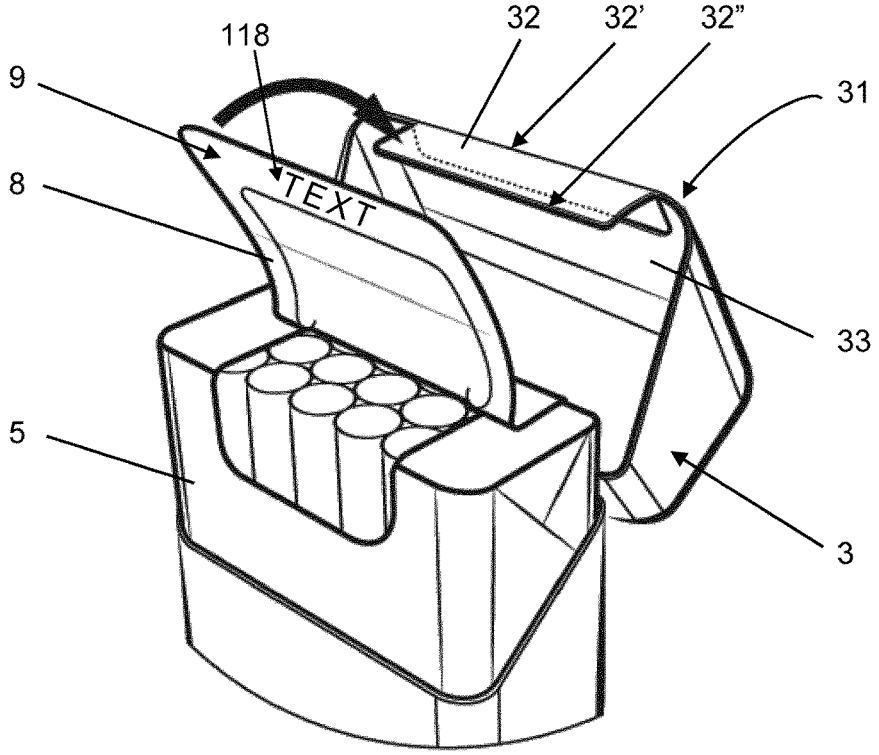
FIG. 2 shows a detail of the container of FIG. 1.

As shown in FIG. 2, the lid front wall comprises a lid outer front panel 31 and two lid inner front panels 32, 33 connected to the lid outer front panel 31 by a crease line. A first lid inner front panel 32 is connected to the lid outer front panel 31 only by the crease line, which defines a rotation axis 32' about which the first lid inner front panel 32 may rotate relative to the lid outer front panel 31. The first lid inner front panel 32 is, thus, rotatable about the lower front edge of the lid 3 relative to the lid outer front panel 31. A second lid inner front panel 33 is connected to the lid outer front panel 31 by the crease line and by permanent adhesive so that the lid outer front panel 31 and the second lid inner front panel 33 do not move relatively.

The outer surface of the label 8 is permanently affixed at its free end 9 to the first lid inner front panel 32, for example with a permanent adhesive provided in fluid state onto the label 8 and/or the inner surface of the lid 3 (e.g. spots of hot melt adhesive or PVA) or on a carrier material (e.g. a double-sided adhesive tape). As a result, movement of the lid 3 causes movement of the label 8 and of the first lid inner front panel 32, which rotates relatively to the lid outer front panel 31. The inner surface of the free end 9 of the label 8 may be substantially free of resealable adhesive to reduce the force required to open the lid 3. Alternatively, the resealable adhesive applied to the inner surface of the label 8 may extend to its free end 9 to firmly close the lid 3.

In order to access the cigarettes within the inner package 5, the hinge lid 3 is moved from the closed position to the open position shown in FIG. 1. As the lid 3 is moved from the closed position, an edge 32" of the first lid inner front panel 32 is brought into pivotal contact with the outer surface of the inner package 5. This causes the first lid inner front panel 32 to pivot about the edge 32" from an initial position in which the first lid inner front panel 32 is substantially parallel to the lid outer front panel 31 to a position in which the first lid inner front panel 32 is approximately perpendicular to the lid outer front panel 31, as can be appreciated in FIG. 3A. In other embodiments, not shown, the first lid inner front panel 32 pivots about the edge 32" from the initial position to a position in which the first lid inner front panel 32 is substantially perpendicular to the inner package 5. Further rotation of the hinge lid 3 peels off the label 8 from the inner package 5, thereby uncovering the access opening 6 in the inner package 5 through which one or more cigarettes can be removed.

Therefore, the container 1 of the present invention provides a two-stage opening of the lid 3. In a first stage, the free end 9 of the reclosable flap or label 8 is pivoted about the inner package 5. In a second stage, the reclosable flap or label 8 is peeled off the inner package 5, thereby uncovering the access opening 6 in the inner package 5. In the first stage the reclosable flap or label 8 preferably does not even partially uncover the access opening 6.

In order to close the container 1, the hinge lid 3 is moved from the open position to the closed position. As the lid 3 is moved from the open position, the label 8 is rolled over the inner package 5, thereby covering the access opening 6 in the inner package 5. The first lid inner front panel 32 extends the label 8 reach in the open position and tensions the label 8 during lid closing, thereby ensuring the precise repositioning of the adhesive label 8 against the inner package 5. The edge 32" of the first lid inner front panel 32 comes into contact with the inner package 5 at a stop motion position shown in FIG. 3A. Further rotation of the hinge lid 3 causes the first lid inner front panel 32 to pivot about the edge 32" from an initial position in which the first lid inner front panel 32 is approximately perpendicular to the lid outer front panel 31 to a position in which the first lid inner front panel 32 is substantially parallel to the lid outer front panel 31, thereby closing the container 1. In other embodiments, not shown, the first lid inner front panel 32 pivots about the edge 32" from an initial position in which the first lid inner front panel 32 is substantially perpendicular to the inner package 5 to a position in which the first lid inner front panel 32 is substantially parallel to the lid outer front panel 31, thereby closing the container 1.

Therefore, the container 1 of the present invention provides a two-stage closing of the lid 3. In a first stage, the reclosable flap or label 8 is rolled over the inner package 5, thereby covering the access opening 6 in the inner package 5. In a second stage, the free end 9 of the reclosable flap or label 8 is pivoted about the inner package 5.

Figure 3A:
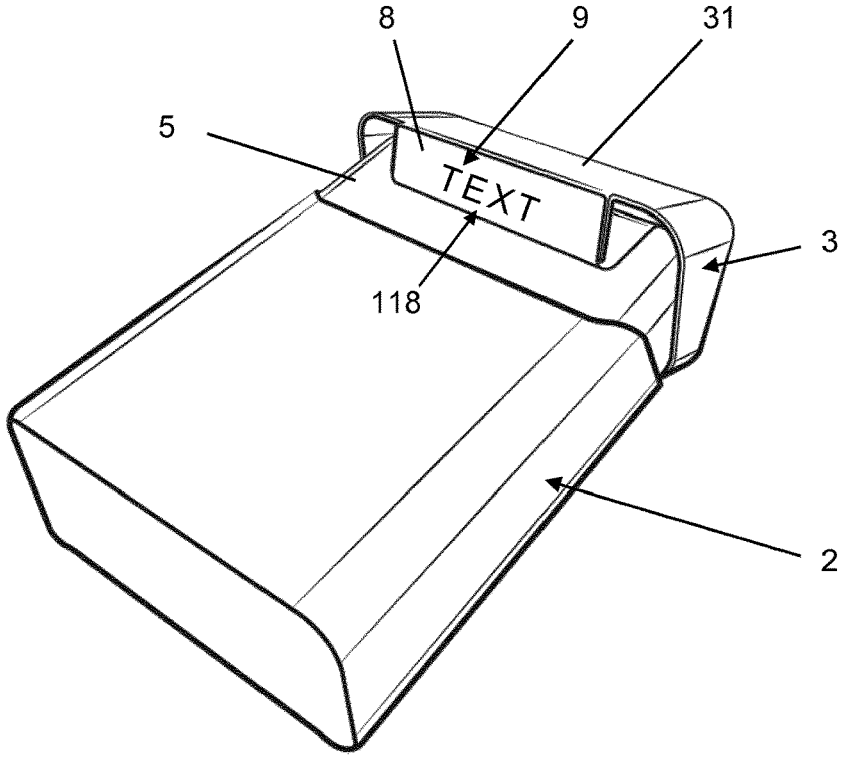
FIGS. 3A and 3B show the container of FIG. 1 with the lid in an intermediate position where

The lid 3 is therefore movable about the box 2 between open and closed positions through an intermediate, stable position shown in FIG. 3A. Movement of the lid 3 between the closed position and the intermediate position, or vice versa, requires overcoming a biasing force, which may be generated by cooperation of the reclosable flap 8 and a movable lid panel, the first lid inner front panel 32 in this embodiment.

The reclosable flap 8 is provided with indicia 118 on its inner side, which is the side that contacts the inner package 5 when the lid 3 is in the closed position. Indicia 118 may be provided at multiple locations on the reclosable flap 8. But, in particular, indicia 118 are provided toward the free end 9 of the reclosable flap where it is attached to the first lid inner front panel 32. The first lid inner front panel 32 is substantially flat and planar. The reclosable flap 8 is also flat and coplanar with the first lid inner front panel 32 where the two substrates are adjacent to one another.

Thus, the indicia 118 on the reclosable flap 8 can be provided on a substantially planar surface in the vicinity of the first lid inner front panel 32. This has been found desirable because it minimises any possible distortion to the indicia 118 that could otherwise be introduced by a curved or non-planar surface.

In this example the indicia 118 is text. However, any other type or combination of indication or marking could be provided including numerals, logos and images. Advantageously the indicia 118 are presented on the reclosable flap 8 without any distortion in the vicinity of the first lid inner front panel 32.

Indicia 118 can also be provided on other parts of the reclosable flap 8 which are free to bend. Indicia 118 on bendable portions of the reclosable flap 8 are selected such that they can be viewed effectively even when distorted on a bendable substrate. A repeating pattern is an example of indicia 118 that might be provided effectively on a flexible substrate.

The indicia 118 can be provided by one or more of an ink, a varnish, a lacquer, embossing, debossing, and hot foil stamping. Where the indicia 118 are provided by an ink they can be separated from the consumer goods in the inner package 5 in order to prevent any potential migration of compounds to the consumer goods. This may be achieved by providing the indicia 118 at a position on the reclosable flap 8 that is offset from the access opening 6 when the hinged lid 3 is in the closed position. Alternatively, or in addition, a coating (not shown) may be provided on the reclosable flap 8 in the vicinity of the indicia 118 to prevent egression of compounds therefrom and into the consumer goods. In one arrangement a frame (not shown) can be provided on the reclosable flap 8 around the portion of the reclosable flap 8 that overlies the access opening 6 when the hinged lid 3 is in the closed position.

Figure 3B:
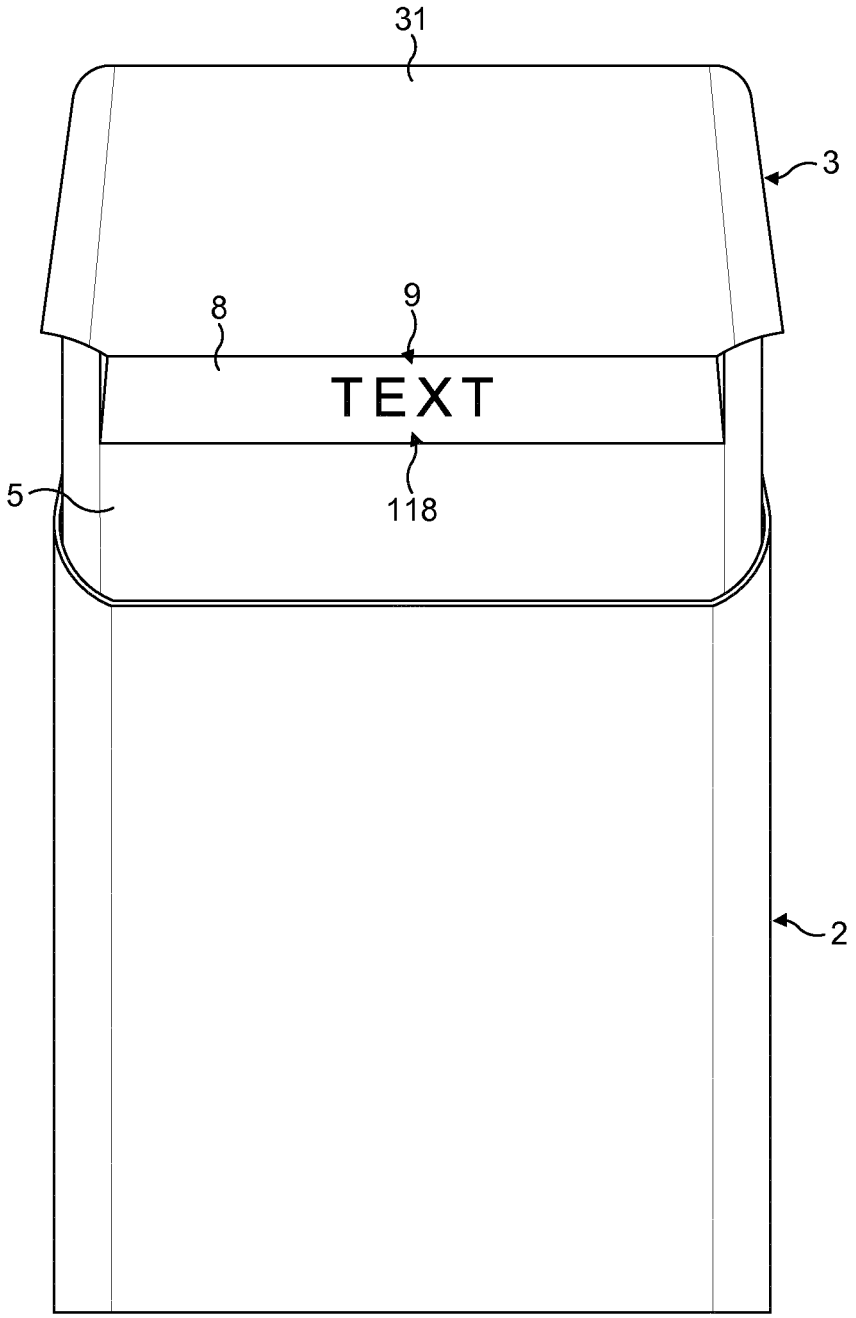

Advantageously the indicia 118 are visible at all times when the hinged lid 3 is moved from the closed position to the open position. In the first opening stage, the free end 9 of the reclosable flap 8 is pivoted about the inner package 5. The indicia 118 are visible at the intermediate, stable position shown in FIG. 3A and FIG. 3B when the container is in various orientations. In just two examples, the indicia 118 are visible in the perspective view shown in FIG. 3A and in the front view shown in FIG. 3B. In the second stage, the reclosable flap 8 is peeled away from the inner package 5, thereby uncovering the access opening 6 in the inner package 5. The indicia 118 that lies adjacent the first lid inner front panel 32 are visible during the first and second opening stages in a planar configuration that avoids any distortion from being introduced.

Figure 4:
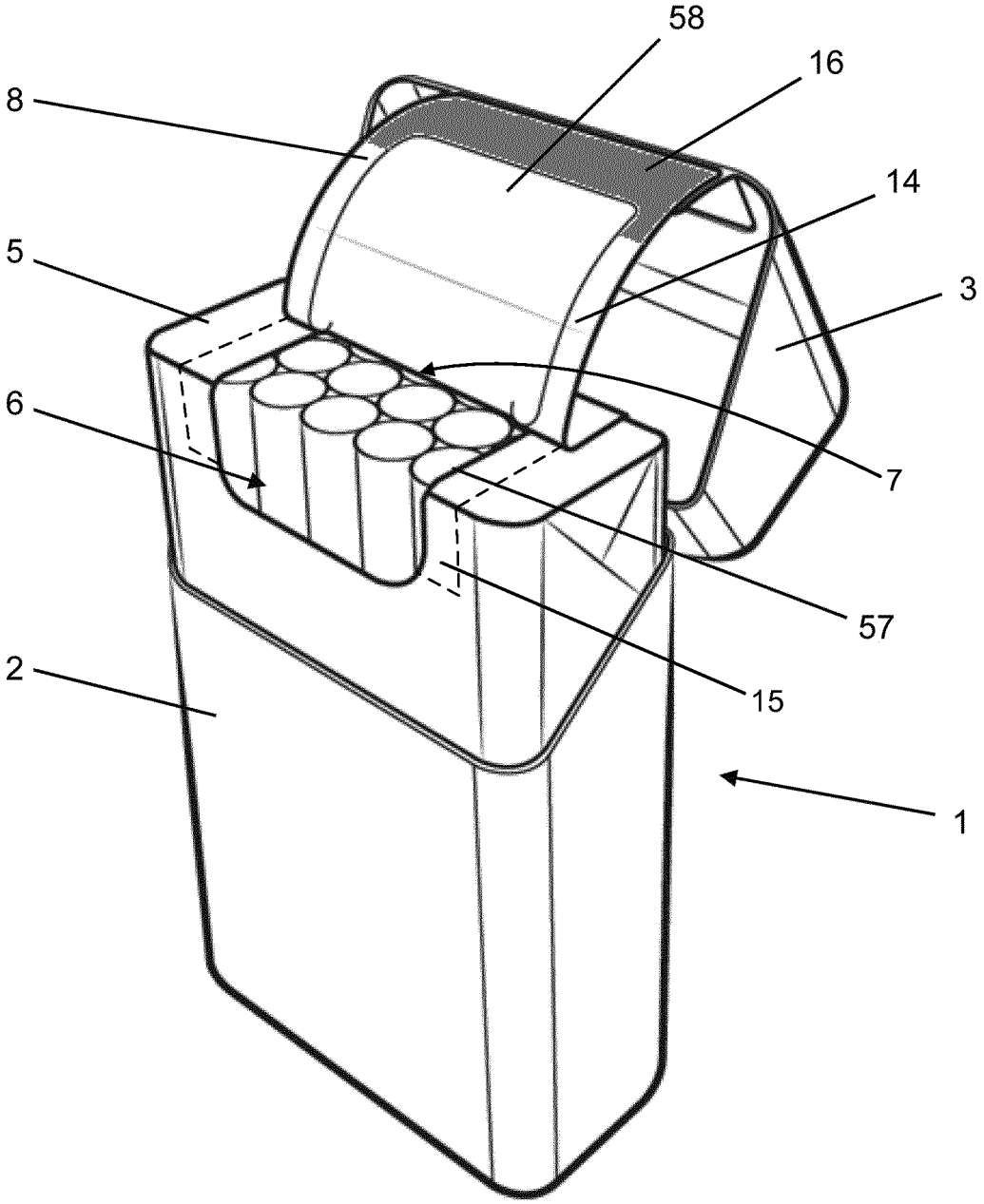
FIG. 4 shows a perspective view of a container in a second embodiment of the invention in a lid open position.

FIG. 4 is a perspective view of another embodiment of a hinged lid container 1. For the sake of brevity, only differences between the containers will be explained below and the same numbering used for the container 1 of the first embodiment will be used to refer to similar elements.

The inner surface of the reclosable flap 8 includes an overlap region where, with the lid 3 in the closed position, the reclosable flap 8 is provided next to the inner package 5, around the periphery 57 of the access opening 6. The inner surface of the reclosable flap 8 includes a first portion 14 having a resealable adhesive to releasably affix the inner package 5 to the reclosable flap 8 and a second portion 16 which is substantially free of adhesive. In the closed position, the first portion 14 of the reclosable flap 8 is provided next to a sealing portion 15 of the inner package 5 so that the respective walls adhere. Of course, in another embodiment the resealable adhesive may be provided on the sealing portion 15 of the inner package 5, rather than the reclosable flap 8. In the closed position, the second portion 16 of the reclosable flap 8 is provided next to a corresponding portion of the inner package 5 on the periphery 57 of the access opening 6, but no adhesion occurs between the two surfaces. The respective surfaces may lie very close together, or be in direct contact, but the absence of sealing engagement means that fluid exchange may be possible between the interior of the inner package 5 and the external environment. This creates a breathable seal for the access opening 6, which can help to preserve the tobacco in the cigarettes under certain atmospheric conditions.

In this arrangement, the second portion 16 of the reclosable flap 8, which is substantially free of resealable adhesive, is provided at the free end 9 of the label 8 and around part of the periphery 57 of the access opening 6. The first portion 14 of the reclosable flap 8, which is provided with resealable adhesive, extends from the second portion 16 to the hinge line 7. As can be appreciated in FIG. 4, the resealable adhesive extends about the left and side edges of the periphery 57 of the access opening 6 in the top wall of the inner package 5, about a portion of the left and side edges of the periphery 57 of the access opening 6 in the front wall of the inner package 5, but does not extend about the lower periphery 57 of the access opening 6.

The second portion 16 of the reclosable flap 8, which is substantially free of resealable adhesive, is provided on an inner surface of the free end 9 of the reclosable flap 8. The area of the second portion 16 of the reclosable flap 8 is larger than the area of the reclosable flap 8 that overlaps the first lid inner front panel 32. In particular, the length of the second portion 16, measured from the free end 9 along the reclosable flap 8, is at least 1 mm greater than the length of the overlapping portion of the reclosable flap 8 to the first lid inner front panel 32, measured from the free end 9 along the reclosable flap 8. This arrangement means that the second portion 16 of the reclosable flap 8, which is substantially free of adhesive, is provided between the edge 32" of the first lid inner front panel 32 and the inner package 5 when the two are brought into pivotal contact.

This pivotal contact occurs about a pivot line in the second portion 16 of the reclosable flap 8. The absence of any adhesive is considered advantageous in this arrangement as it prevents any interference in the pivoting movement. The reverse occurs as the lid 3 is moved from the open position towards the closed position whereby the edge 32" can pivot along a pivot line in the second portion 16 of the reclosable flap 8.

A low friction interaction may be provided between the reclosable flap 8 and the inner package 5 in areas where there is an absence of adhesive. This may cause some movement of the pivot line of the edge 32" during the opening and/or closing of the lid 3. Advantageously the edge 32" is provided in the second portion of the reclosable flap 8 for all possible positions of the pivot line.

FIG. 5 is a plan view of the inner surface of the reclosable flap 8 used in the container 1 represented in FIG. 4. The periphery 57 of the access opening 6 has been represented for ease of reference but is not a part of the reclosable flap 8. The hinge line 7 is also represented in dotted line. Similarly, transverse dotted lines represent the relative position of the upper, front and upper, back edges of the inner package 5 when the reclosable flap 8 is over the inner package 5 in the closed position.

As can be seen in FIG. 5, the reclosable flap 8 includes a back surface 81, a top surface 82 and a front surface 83 when the lid 3 is in the closed position. These are the positions of the relevant surfaces 81, 82, 83 of the reclosable flap 8 on the rectangular cuboid which is the inner package 5.

It has been found advantageous to provide resealable adhesive on the first portion 14 of the reclosable flap 8 on at least the top surface 82 and the front surface 83. This can allow the reclosable flap 8 to wrap around the top, front edge of the inner package 5 in a reliable way, which can help to ensure that the reclosable flap 8 is positioned correctly when the lid 3 is moved from the open towards the closed position.

The outer surface of the free end 9 of the reclosable flap 8 is provided with a permanent adhesive (not shown) for attachment to the inner surface of the lid 3.

In another embodiment, not shown, the inner package 5 may be provided with a release agent such that when a reclosable flap 8, substantially comprising an adhesive layer, overlies the inner package 5, the reclosable flap 8 will not adhere to the inner package 5 in that region.

In this arrangement, the movable portion of the reclosable flap 8 includes the front surface 83 and a substantial portion of the top surface 82, while the non-movable portion includes the back surface 81 and a portion of the top surface 82 proximate the back, upper edge The hinge line 7 is provided at a distance of around 7.5 mm from the top, back edge of the inner package 5. The top wall of the inner package 5 has a length of around 21.5 mm, and therefore the hinge line 7 is provided at a distance that is around 30% of the distance from the top, back edge of the inner package 5 to the top, front edge of the inner package 5. Where the inner package 5 accommodates cigarettes the position of the hinge line 7 roughly corresponds to the interface between a rear row and a middle row of cigarettes; this is best appreciated with reference to FIG. 7.

Figure 6:
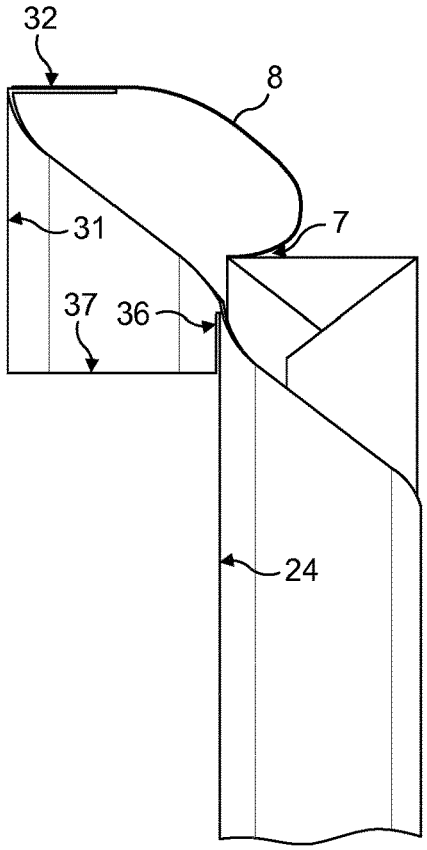
FIG. 6 is a side view of the container with a hinged lid in a first open position in the second embodiment of the invention.
Figure 7:
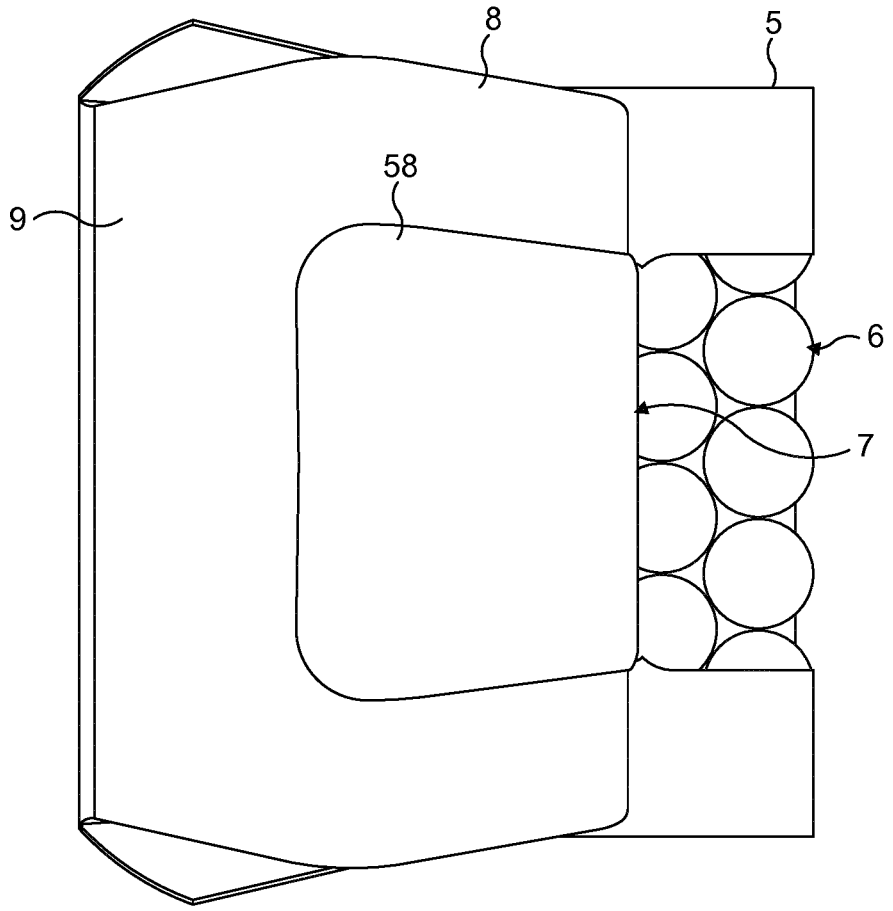
FIG. 7 is a top view of the container shown in FIG. 6.
Figure 8:
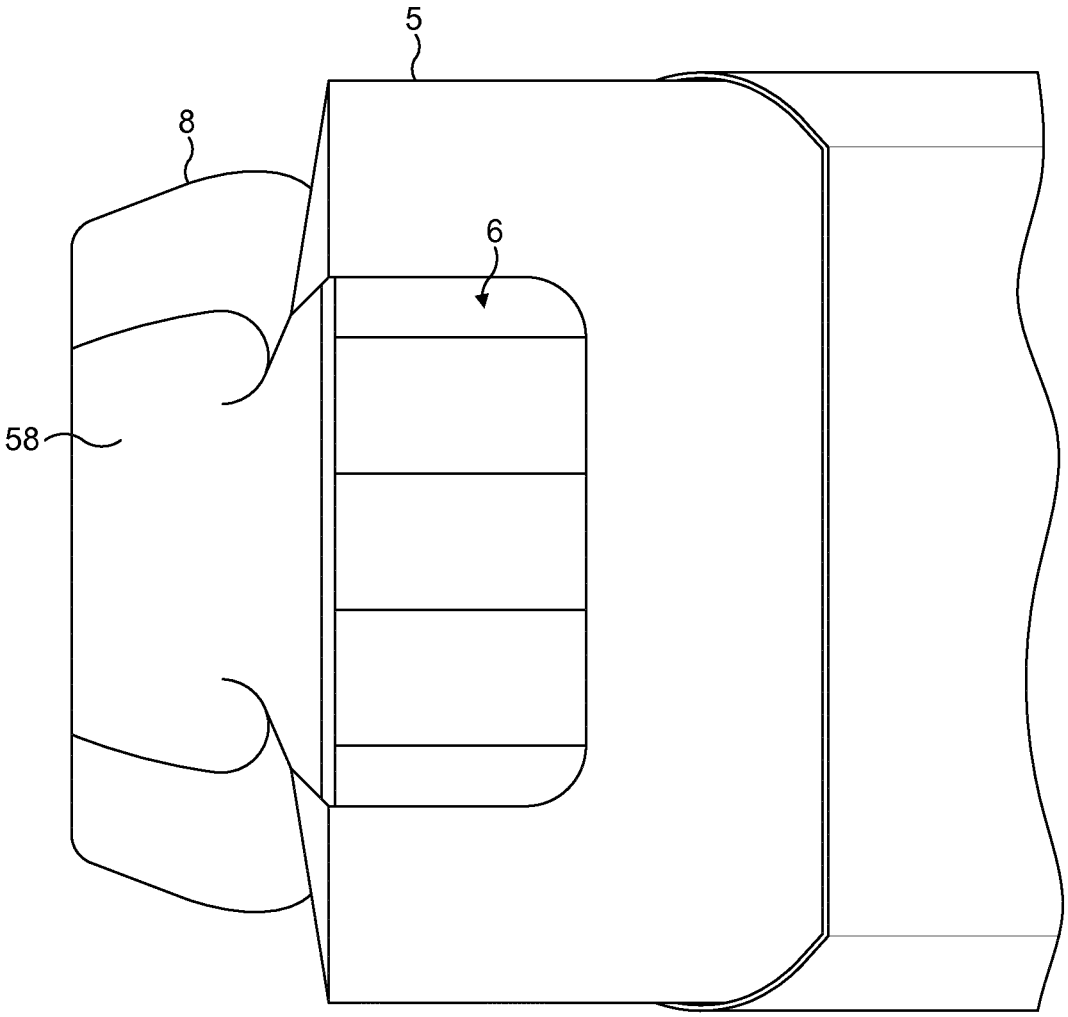
FIG. 8 is a front view of the container shown in FIG. 6.
Figure 18:
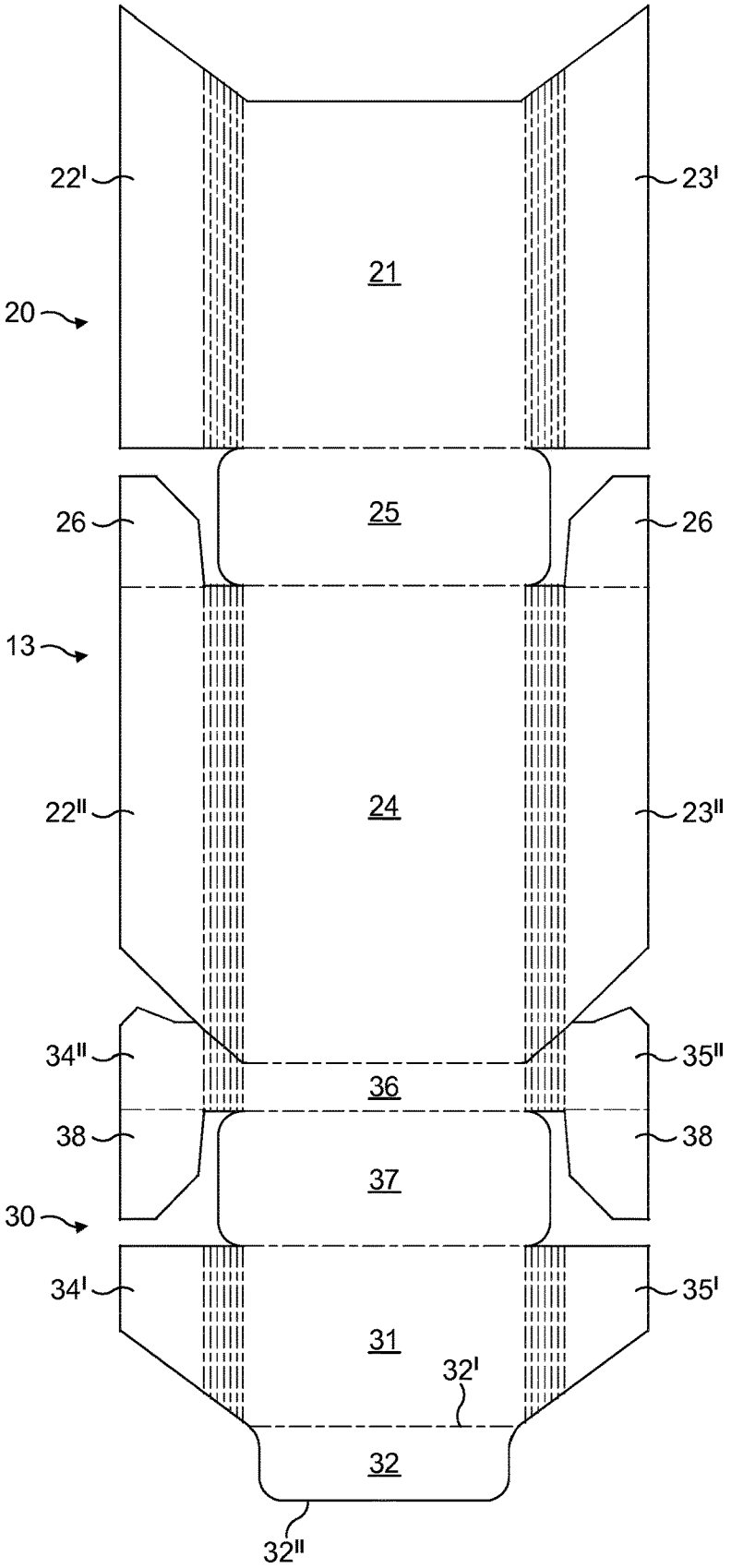

FIG. 6 is a side view of the outer housing 1 formed by the blank 13 shown in FIG. 18 together with the reclosable flap 8 shown in FIG. 5. FIG. 7 is a top view of the same outer housing 1, and FIG. 8 is a front view. The hinged lid 3 is shown in this configuration in a first open position. In the first open position the hinged lid 3 is rotated through substantially 180° from the closed position so that a lid back wall 36 is substantially parallel with and adjacent to a box back wall 24, although the two are not in contact. In this first open position the lid top wall 37 is arranged substantially perpendicularly to the box back wall 24.

Figure 9:
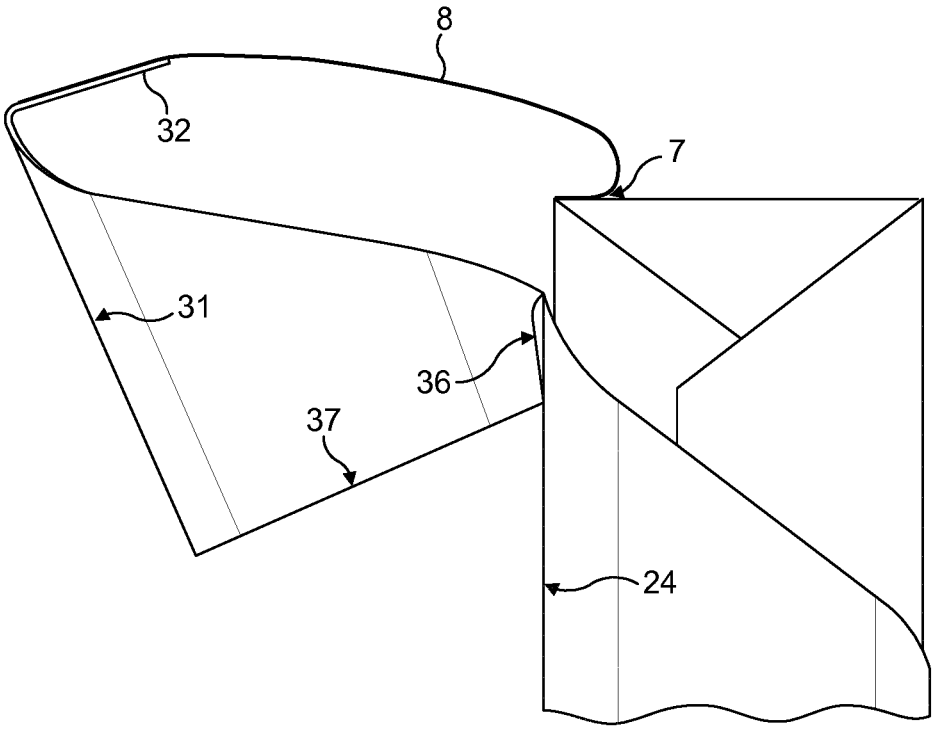
FIG. 9 is a side view of the container shown in FIG. 6 with the hinged lid in a second open position.

FIG. 9 is another side view of the outer housing formed by the blank 13, showing the hinged lid 3 in a second open position. In the second open position the lid back wall 36 is arranged in contact with the box back wall 24. Thus, an acute angle is formed between the lid top wall 37 and the box back wall 24. The second open position corresponds to a "fully open" position of the hinged lid 3, which is at an extreme end of the normal operating movement of the lid 3.

A ratio can be defined between a first distance measured when the hinged lid 3 is in the first or second open position along a straight line between a lower front edge of the lid front wall, which in this embodiment corresponds to the rotation axis 32' of the first lid inner front panel 32, and the hinge line 7 and a second distance along the reclosable flap 8 between the hinge line 7 and an edge of the reclosable flap 8 at the free end 9. The dimensions of the reclosable flap 8 and the blank 13 are selected so that the ratio between the first distance and the second distance is comprised between 70% and 100%. The second distance is a partly curved path along the reclosable flap 8. By contrast, the first distance is a straight line between the hinge line 7 and the rotation axis 32' of the first lid inner front panel 32 to which the reclosable flap 8 is attached. The position of the hinge line 7 can be seen most clearly with reference to FIG. 7, which also shows the flap 58 in the inner package 5. This arrangement places the reclosable flap 8 in tension in both the first open position and the second open position. The tension in the reclosable flap 8 is higher in the second open position, as can be observed by the flatter shape that it adopts. The provision of tension in the reclosable flap 8 in the first and second open positions is advantageous because it biases the hinged lid 3 away from the first or second open positions and towards the closed position. This can improve the positioning of the reclosable flap 8 during the closing operation, especially against the top surface of the inner package 5.

In both the first and second open positions the reclosable flap 8 includes a flat portion and a curved or convex portion. In some configurations a concave curved portion may also be provided in the reclosable flap 8.

By a comparison between FIGS. 6 and 9, it will be appreciated that an angle between the first lid inner front panel 32 and the lid outer front panel 31 is changed when the lid 3 is moved from the first open position to the second open position. In the first open position the angle between the first lid inner front panel 32 and the lid outer front panel 31 is approximately 90°. In the second open position an acute angle that is less than 90° is formed between the first lid inner front panel 32 and the lid outer front panel 31.

In both the first and second open positions a portion of the reclosable flap 8 is held in a substantially flat, tensioned configuration between the hinge line 7 and the first lid inner front panel 32. In the first open position the length of the flat portion of the reclosable flap 8 is approximately 14 mm, which includes the portion where the reclosable flap 8 is attached to the (flat) first lid inner front panel 32. In the second open position the length of the flat portion of the reclosable flap 8 is approximately 37 or 38 mm, measured from the free end 9 of the reclosable flap 8. This also includes the portion where the reclosable flap 8 is attached to the first lid inner front panel 32. Thus, the length of the flat portion of the reclosable flap 8 is increased when the lid 3 is moved from the first open position to the second open position by a factor or a ratio which is approximately 2.7.

Figure 10:
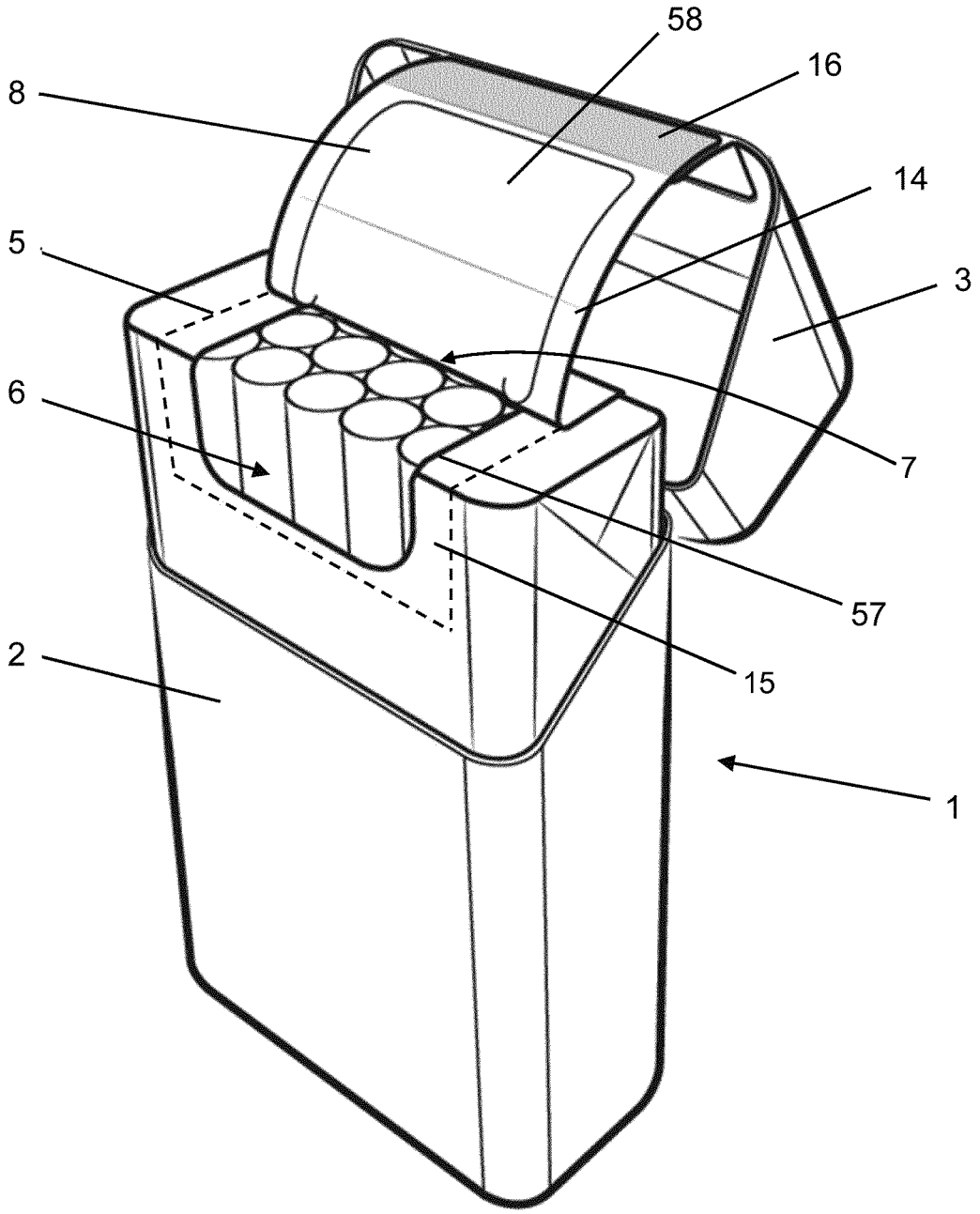
FIG. 10 shows a perspective view of a container in a third embodiment of the invention in a lid open position.
Figure 11:
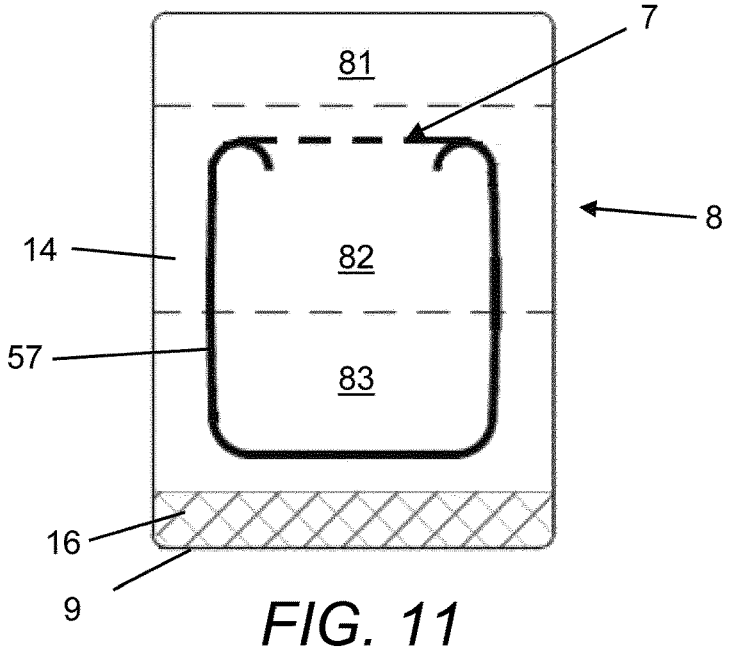
FIG. 11 shows a plan view of a reclosable flap of the container in the third embodiment of the invention.
Figure 12:
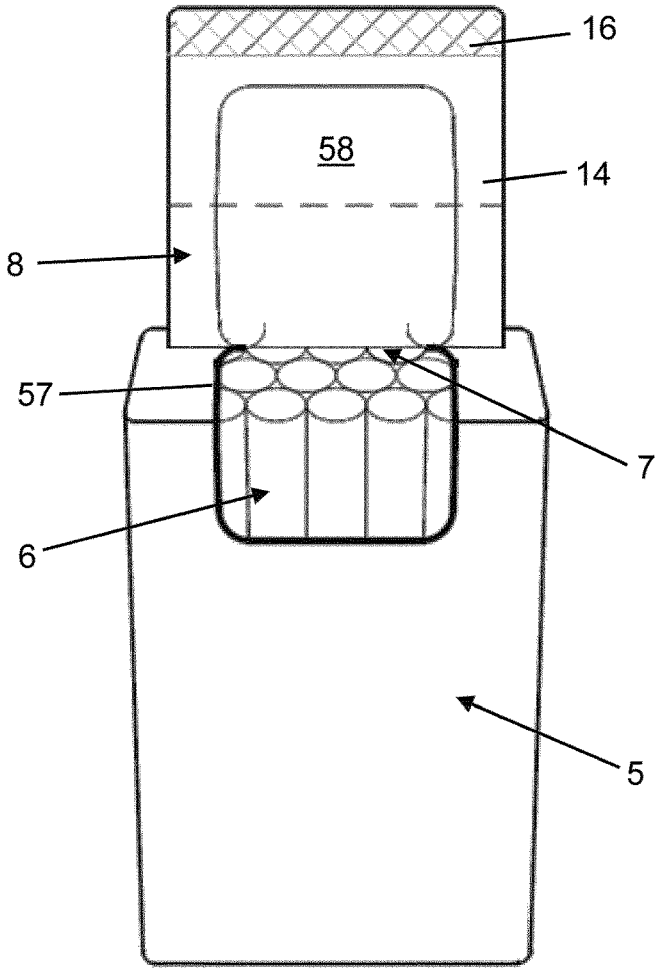
FIG. 12 is a front view of an inner package of the container in the third embodiment of the invention.

FIG. 10 is a perspective view of a container 1 in a third embodiment of the invention, and FIG. 11 is a plan view of the reclosable flap 8. FIG. 12 is a front view of an inner package 5 for use in the container 1 of the present invention with the reclosable flap 8 of FIG. 11. This embodiment differs from the second embodiment in that the second portion 16 of the reclosable flap 8 has approximately the same size and shape as the first lid inner front panel 32. In this arrangement the second portion 16 of the reclosable flap 8 does not extend as far as the access opening 6 when the hinged lid 3 is in the closed position. Thus, in this embodiment the resealable adhesive extends about the entire periphery 57 of the access opening 6.

Figure 13:
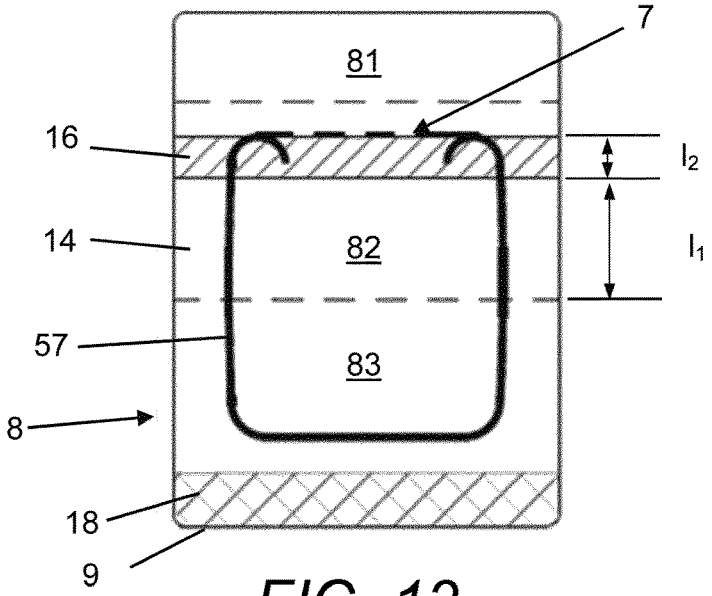
FIG. 13 shows a plan view of an alternative reclosable flap of the container in the third embodiment.
Figure 14:
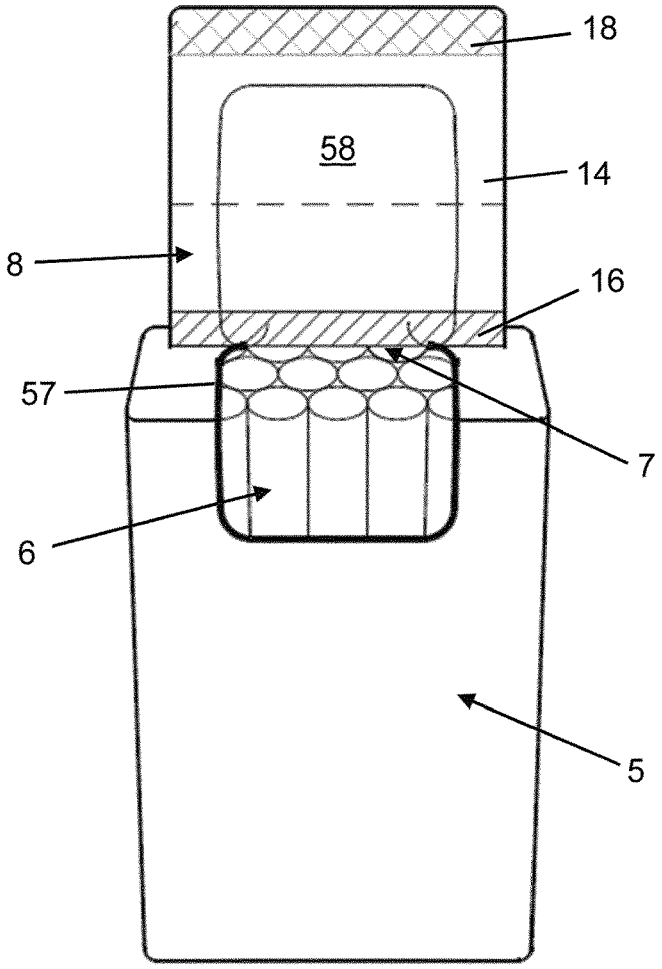
FIG. 14 is a front view of an alternative inner package of the container in the third embodiment of the invention.

FIG. 13 shows a plan view of an alternative reclosable flap 8 for use in a container 1 of the present invention, and FIG. 14 shows a front view of an inner package 5 with the reclosable flap 8 of FIG. 13. The reclosable flap 8 is provided with a first portion 14 having a resealable adhesive, and a second portion 16 which is substantially free of resealable adhesive, and which is adjacent the hinge line 7. The reclosable flap 8 also includes a third portion 18 substantially free of adhesive which is adjacent the hinged lid 3, specifically at the connecting portion (free end 9) of the label 8. As can be appreciated in FIG. 13, the third portion 18 does not include a portion of the periphery 57 of the access opening 6. Therefore, the resealable adhesive extends about the lower edge of the periphery 57 of the access opening 6, about the left and right edges of the periphery 57 of the access opening 6 in the front wall of the inner package 5 and about a portion of the left and right edges of the periphery 57 of the access opening 6 in the top wall of the inner package 5.

In this arrangement, the reclosable flap 8 advantageously avoids tobacco crumbs from sticking to the flap 8 adjacent the hinge line 7, promotes wide opening of the lid 3, and improves the ease with which the lid 3 opens. Further, the container 1 promotes preservation of tobacco by enabling oxygen exchange between the interior of the inner package 5 and the external environment.

In this embodiment the first portion 14 of the reclosable flap 8 has a length $l_1$ of around 9 mm, extending toward the hinge line 7, in a direction substantially perpendicular to the hinge line 7, along the top surface 82. In this same embodiment, the second portion 16 of the reclosable flap 8, which is substantially free of resealable adhesive, has a length 12 of around 9 mm, extending from the hinge line 7, in a direction substantially perpendicular to the hinge line 7, along the top surface 82.

In another embodiment, not shown, the first portion 14 of the reclosable flap 8 has a length $l_1$ of around 9 mm, extending toward the hinge line 7, in a direction substantially perpendicular to the hinge line 7, along the top surface 82. In this same embodiment, the second portion 16 of the reclosable flap 8, which is substantially free of resealable adhesive, has a length $l_2$ of around 9 mm, extending from the hinge line 7, in a direction substantially perpendicular to the hinge line 7, along the top surface 82.

In an alternative embodiment, not shown, the third portion 18 includes a lower portion of the periphery 57 of the access opening 6 in a similar embodiment as the second portion 16 of the label 8 represented in FIG. 5. As a result, the resealable adhesive extends about a portion of the left and right edges of the periphery 57 of the access opening 6 in the top wall of the inner package 5, and about a portion of the left and side edges of the periphery 57 of the access opening 6 in the front wall of the inner package 5. The resealable adhesive does not extend about the lower periphery 57 of the access opening 6.

The second portion 16 of the reclosable flap 8 has been described as being substantially free of resealable adhesive. However, at least some of the advantageous effects described herein may be realised by providing the second portion 16 with a reduced adhesiveness, in comparison to the first portion 14.

Figure 15:
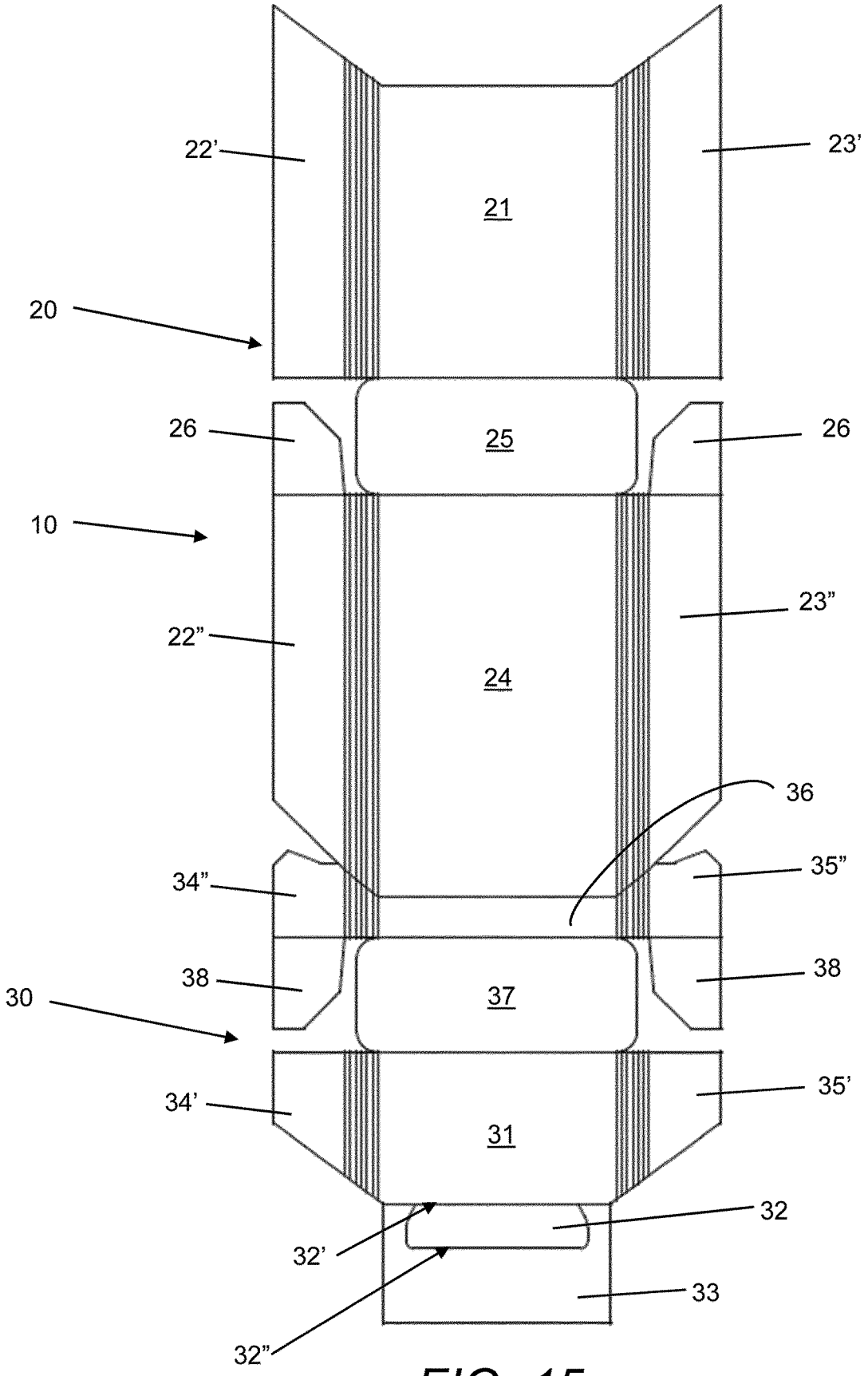
FIGS. 15 to 18 show four different embodiments of a blank for forming an outer housing of the present invention.

FIG. 15 shows a blank 10 for forming the outer housing 1 represented in FIGS. 1 to 4 and FIG. 10. The blank 10 is divided into two blank portions, a box portion 20 and a lid portion 30. Each blank portion comprises a plurality of panels in which each individual panel is connected to at least another panel, for example, by a crease or fold line.

The box portion 20 comprises a box front panel 21, box outer and inner left side panels 22', 22", box outer and inner right side panels 23', 23", a box back panel 24, a box bottom panel 25 and two box gluing flaps 26. Although in FIG. 15 the connections of the box front panel 21 and the box back panel 24 to the box outer and inner left and right side panels 23', 23", 24', 24" are shown as a plurality of parallel longitudinal crease lines, these connections could equally be made by single longitudinal crease lines. The remaining panel connections are single transverse crease lines.

In order to assemble the box 2 of the outer housing 1, the box gluing flaps 26 are glued to the box bottom panel 25 to form the box bottom wall. To form the box left side wall, the box inner left side panel 22" is glued to the box outer left side panel 22'. The box inner right side panel 23" is glued to the box outer right side panel 23' to form the box right wall.

The lid portion 30 comprises a lid outer front panel 31, two lid inner front panels 32, 33, lid outer and inner left side panels 34', 34", lid outer and inner right side panels 35', 35", a lid back panel 36, a lid top panel 37 and two lid gluing flaps 38. The lid back panel 36 is hingedly connected (e.g. by a crease line) to box back panel 24.

Although in FIG. 15 the connections of the lid outer front panel 31 and the lid back panel 36 to the lid outer and inner left and right side panels 34', 34", 35', 35" are shown as a plurality of parallel longitudinal crease lines, these connections could equally be made by single longitudinal crease lines. The remaining panel connections are single transverse crease lines.

In this embodiment, both the first and second lid inner front panels 32, 33 are connected to the lid outer front panel 31 as the first lid inner front panel 32 is surrounded by the second lid inner front panel 33. Although not shown in FIG. 4, the first and second lid inner front panels 32, 33 may be connected by one or more breakable connections. These one or more breakable connections may be provided along at least one of the edges of the first lid inner front panel 32 that are not connected to the lid outer front panel 31, preferably, at least along an edge 32", which is opposite the edge 32' of the first lid inner front panel 32 that is connected to the lid outer front panel 31.

To form the lid 3, both lid inner front panels are folded 180° with respect to the lid outer front panel 31 so that they contact, but only the lid outer front panel 31 and the second lid inner front panel 33 are glued together. The lid gluing flaps 38 are glued to the lid top panel 37 to form the lid top wall. The lid left side wall is formed by gluing the lid inner left side panel 34" to the lid outer side panel 34'. Finally, the lid inner right side panel 35" is glued to the lid outer right side panel 35'.

Preferably, an adhesive-free region is defined around the periphery of the first lid inner front panel 32 to prevent adhesive trickling into the first lid inner front panel 32. The average width of the adhesive-free region may be of at least 1 mm, for example of about 2 mm.

Figure 16:
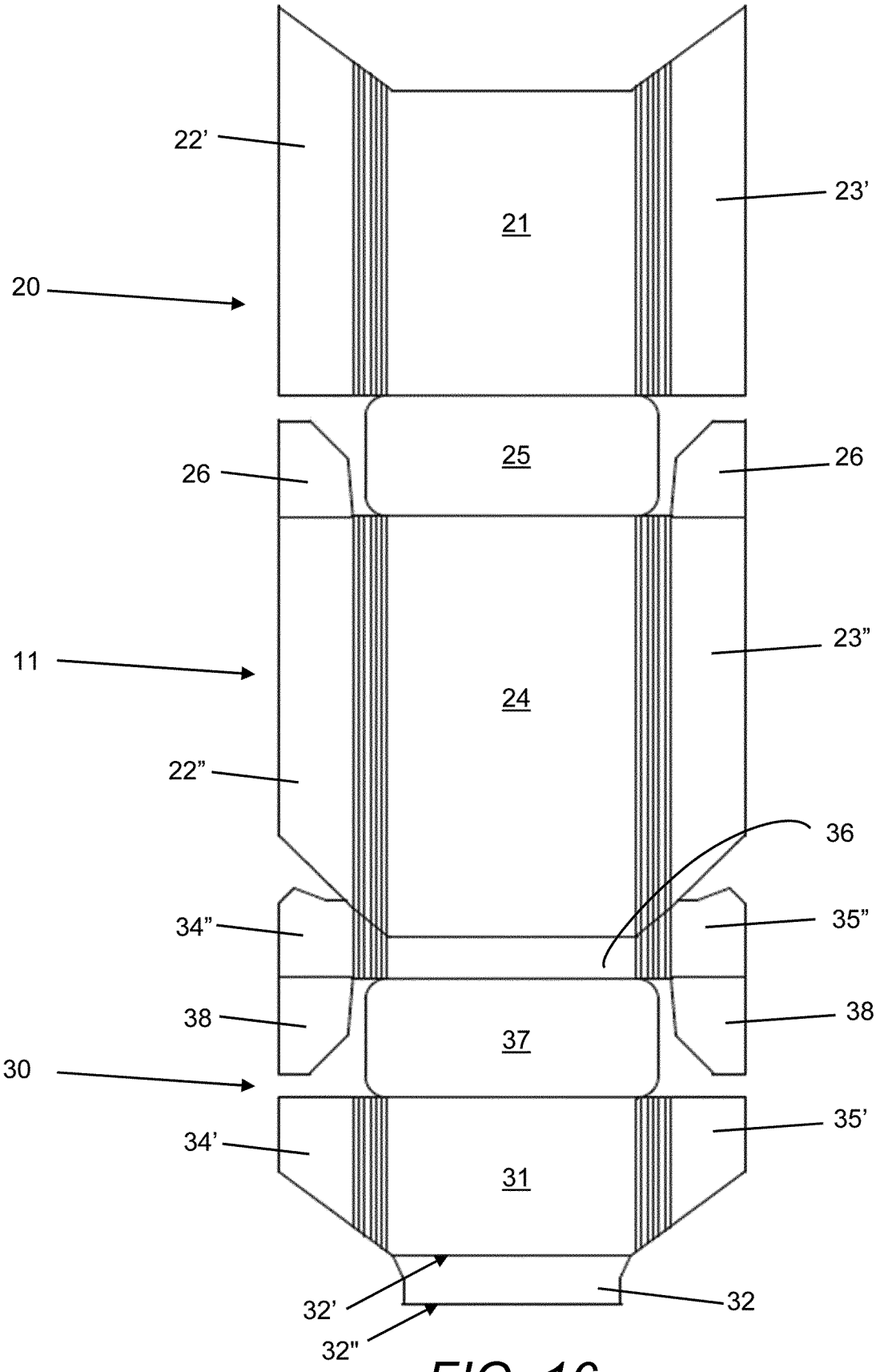
Figure 17:
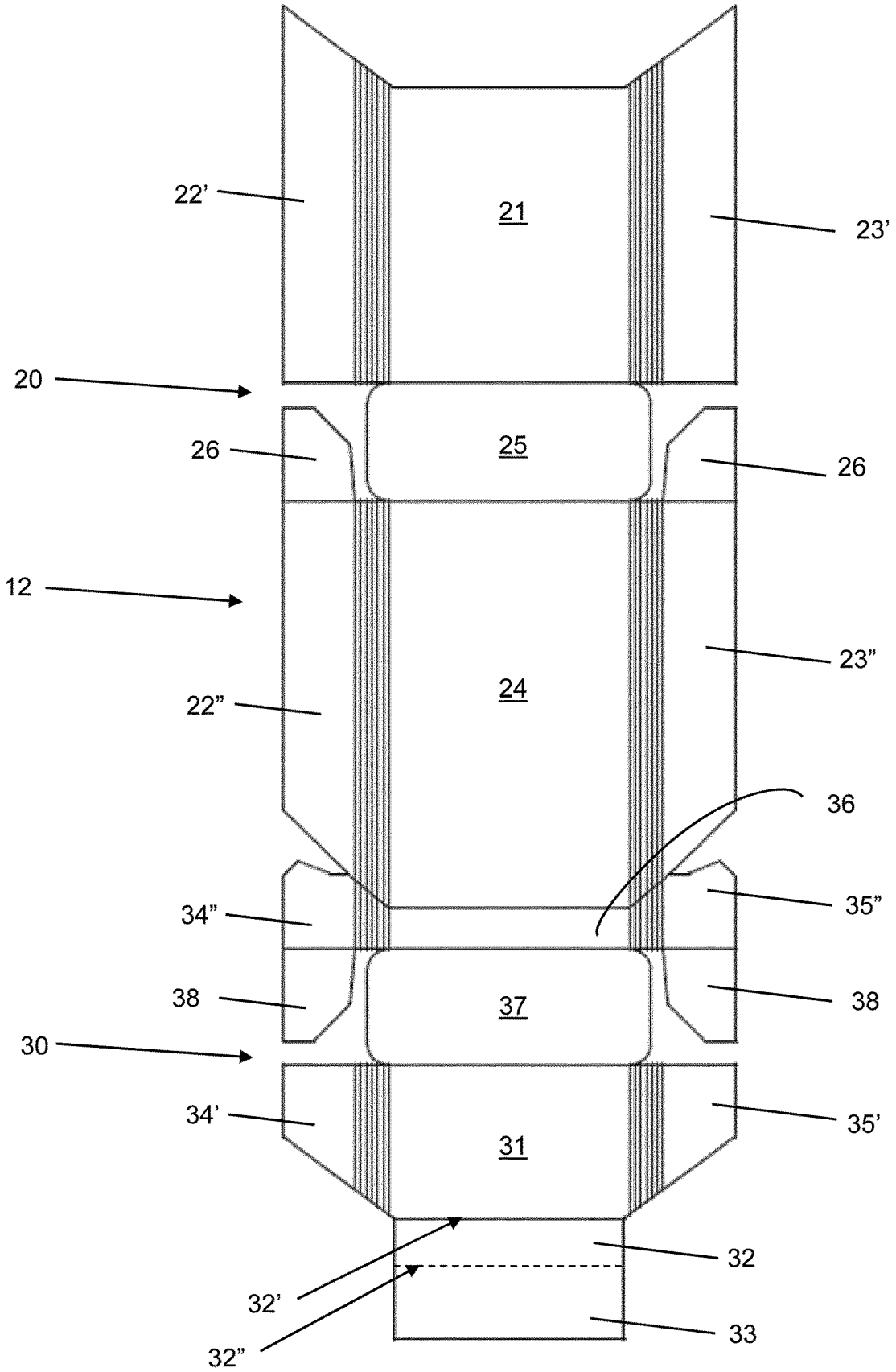

FIGS. 16 to 18 show alternative blanks 11, 12, 13 for forming an outer housing 1 similar to the one represented in FIGS. 1 to 4 and FIG. 10. For the sake of brevity, only differences between the blanks will be explained below and the same numbering used for the blank 10 of the first embodiment will be used to refer to similar elements.

The blank 11 of the second embodiment shown in FIG. 16 differs from the blank 10 of the first embodiment in that the lid portion 30 has only one lid inner front panel 32. When the lid 3 is formed, the lid inner front panel 32 is folded 180° with respect to the lid outer front panel 31 so that they contact, but no glue is applied to adhere those two panels.

The blank 12 of the third embodiment shown in FIG. 17 differs from the blank 10 of the first embodiment in that the first lid inner front panel 32 is connected at one edge 32' to the lid outer front panel 30 by a crease or fold line and to the second lid inner front panel 33 at another, opposite edge 32" by a line of weakness, such as a row of perforations. The line of weakness 32" may be formed during a step of forming the outer housing 1, preferably before any panels of the blank 12 are folded, for example with a rotary scoring tool.

When the lid 3 is formed, the first lid inner front panel 32 is folded 180° with respect to the lid outer front panel 31. As the second lid inner front panel 33 is connected to the first lid inner front panel 32, by folding the first lid inner front panel 32 with respect to the lid outer front panel 31, the second lid inner front panel 33 and the lid outer front panel 31 also in contact. These latter panels are adhered together.

Preferably, an adhesive-free region is defined around the periphery of the first lid inner front panel 32 to prevent adhesive trickling into the first lid inner front panel 32. The average width of the adhesive-free region may be of at least 1 mm, for example of about 2 mm.

When the reclosable flap 8 is affixed to the first lid inner front panel 32 and the container 1 is opened for the first time, the opening force breaks the line of weakness 32" that connects the first and second lid inner front panels 32, 33, thereby mobilising the first lid inner front panel 32, which becomes rotatable about the crease line 32' that connects it to the lid outer front panel 31. The second lid inner front panel 33 remains attached to the lid outer front panel 31.

The blank 13 of the fourth embodiment shown in FIG. 18 differs from the blank 11 shown in FIG. 16 in the size and shape of the first lid inner front panel 32.

When the lid 3 is formed, the lid outer front panel 31 is moved towards the reclosable flap 8 so that the first lid inner front panel 32 comes into contact with an outer surface of the reclosable flap 8. As the first lid inner front panel 32 in blank 11 is neither glued to the lid outer front panel 31 nor connected to another lid panel by one or more breakable connections, the first lid inner front panel 32 rotates and there is a risk that it does so into an undesirable configuration. In particular, there is a risk that the first lid inner front panel 32 has an angle of more than 90° from the lid outer front panel 31. Such an arrangement would be undesirable because it would prevent the first lid inner front panel 32 from bonding effectively with the reclosable flap 8. In addition, the first lid inner front panel 32 would be likely to sweep a liquid permanent adhesive off the free end 9 of the reclosable flap 8. This would reduce the likelihood of effective bonding, and may cause unintentional bonding between other surfaces. This can be prevented by dimensioning the first lid inner front panel 32 so that, prior to any attachment between the first lid inner front panel 32 and the reclosable flap 8, the first lid inner front panel 32 brushes against the top, front edge of the reclosable flap 8 when the hinged lid 3 is moved from the open position towards the closed position.

These undesirable effects are advantageously mitigated by the present arrangement of the blank 13, which is achieved in part by having a first lid inner front panel 32 with a length of around 10.5 mm extending in a direction that is perpendicular to the crease line 32'.

It has been found that relative sizes of the first lid inner front panel 32, lid outer front panel 31 and lid back panel 36 contribute to mitigate the above undesirable effects. Blank 13 is sized and shaped to mitigate these undesirable effects. In particular, the lid outer front panel 31 of the blank 13 has a length of around 30 mm, and the lid back panel 36 has a length of around 8 mm. As a result, a ratio between the length of the first lid inner front panel 32 to the length of the lid outer front panel 31 is of 0.35, while a ratio between the length of the first lid inner front panel 32 to the length of the lid back panel 36 is of about 1.3. A ratio between a length of the first lid inner front panel 32 to a distance between a top, front edge 19 of the inner package 5 and a top, front edge 27 of the box 2 is at least 0.3, and preferably no more than 0.5.

Figure 19A:
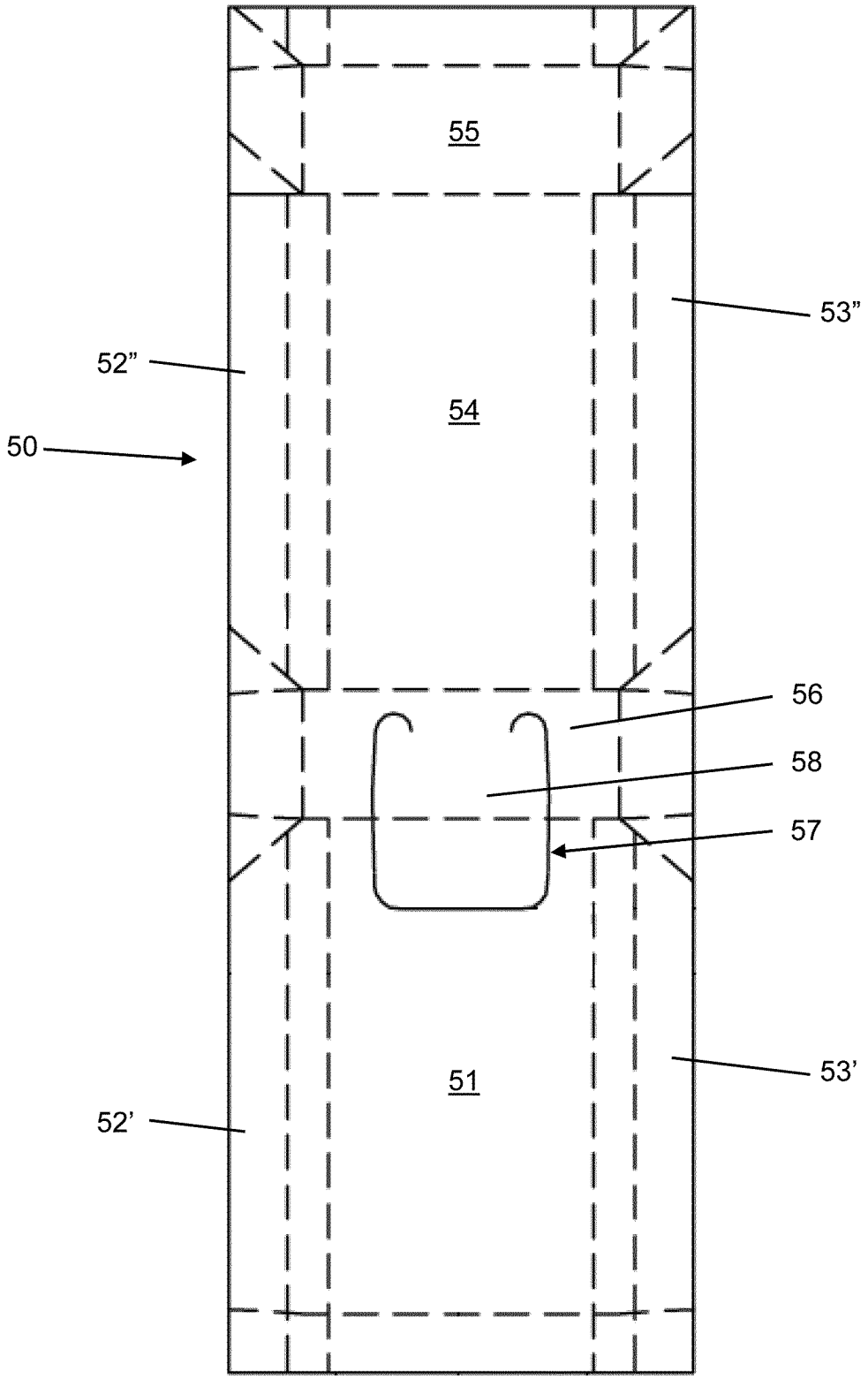
FIGS. 19A and 19B show two different embodiments of a blank for forming an inner package of the present invention.
Figure 19B:
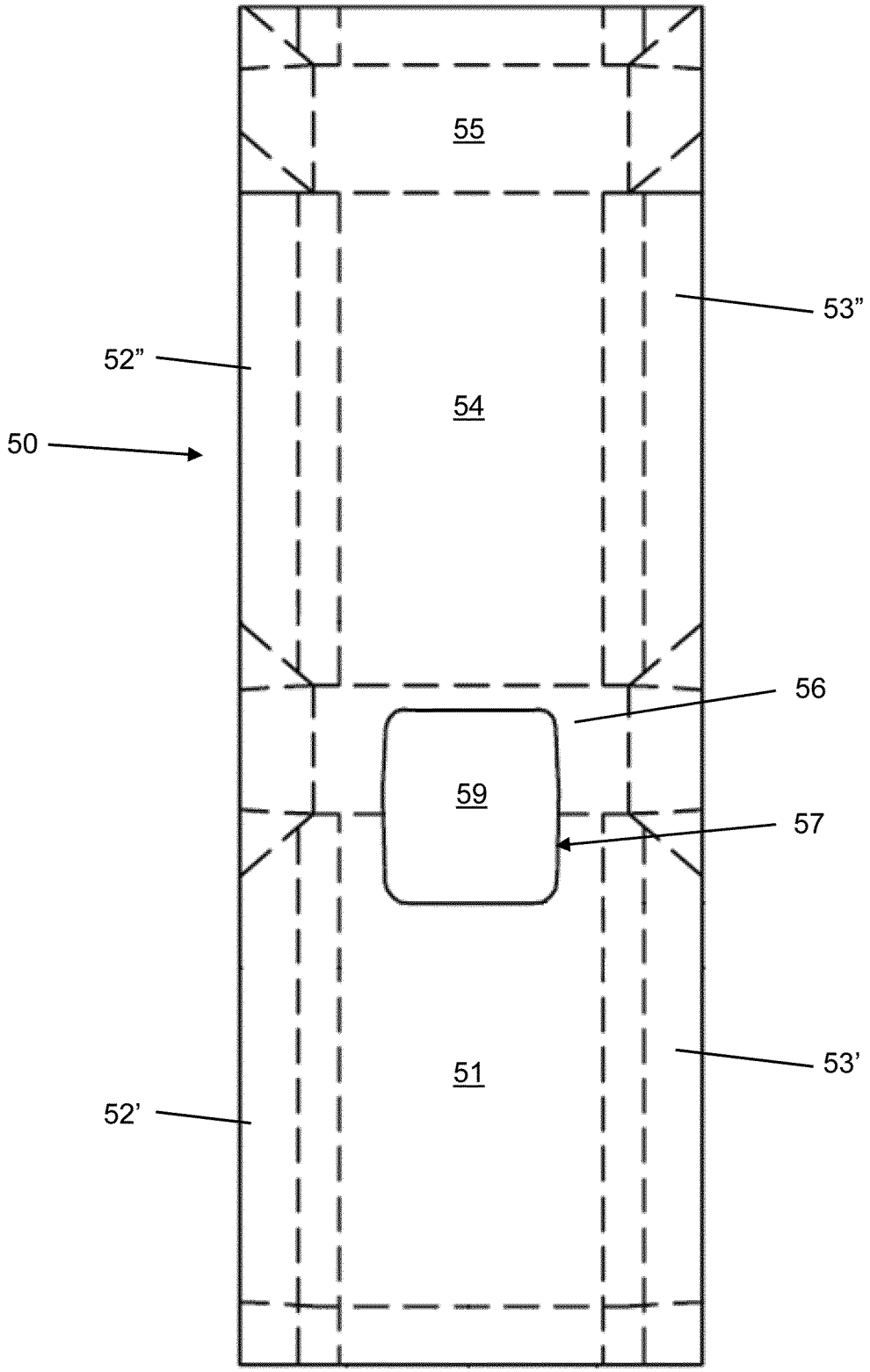

FIGS. 19A and 19B show two alternative blanks for forming the inner package 5 represented in FIGS. 1 to 14. The inner package blanks 50 are made from a substantially rectangular sheet of wrapping material that is folded along the longitudinal and transverse dashed lines represented in FIGS. 19A and 19B.

The inner package blank 50 comprises an inner package front panel 51, inner package outer and inner left side panels 52', 52", inner package outer and inner right side panels 53', 53", an inner package back panel 54, an inner package bottom panel 55 and an inner package top panel 56. Although in FIGS. 19A and 19B the separation of the inner package front panel 51 and the inner package back panel 54 from the inner package outer and inner left and right side panels 53', 53", 54', 54" is shown each as two parallel longitudinal fold lines, this separation could equally be made by a single longitudinal fold line.

The inner package blank 50 represented in FIG. 19A includes a cut line 57 that defines a flap 58. A line of weakness may be provided instead of the cut line so that the flap 7 separates from the inner package 5 only upon first opening of the container 1.

To form an inner package 5 from any of the blanks 50 represented in FIGS. 19A and 19B, the inner package outer and inner left side panels 52', 52" are connected (e.g. by glue application or heat-sealing) to each other to form the inner package outer left wall. The inner package right wall is formed by connecting the inner package outer and inner right side panels 53', 53".

In the inner package blank 50 represented in FIG. 19B, the cut line 57 defines a cut-out 59.

Figure 20:
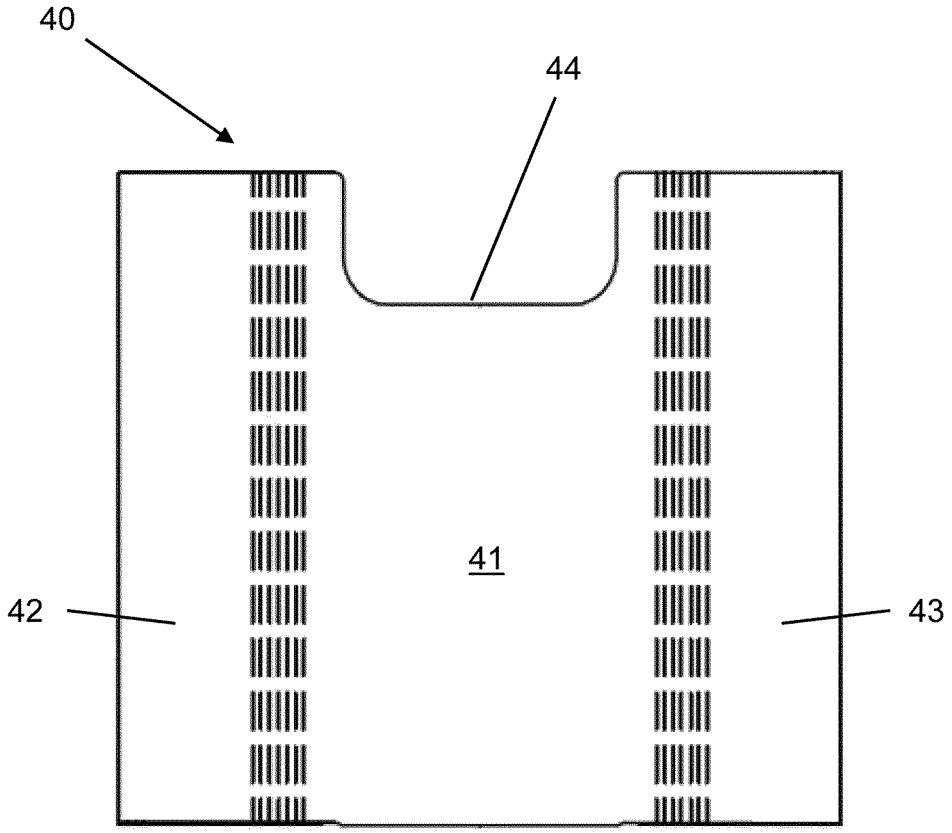
FIG. 20 shows an embodiment of a blank for forming an inner frame of the present invention.

FIG. 20 shows a blank 40 for forming the inner frame housed in the inner package 5 of FIGS. 1 to 14. The inner frame blank 40 comprises an inner frame front panel 41, an inner frame left side panel 42 and an inner frame right side panel 43. Although in FIG. 20 the connections of the inner frame front panel 41 to the inner frame left and right side panels 42, 43 are shown as a plurality of parallel longitudinal crease lines, these connections could equally be made by single longitudinal crease lines.

The inner frame front panel 41 includes a rectangular cut-out 44 at the top free edge, in order to facilitate removal of the cigarettes from the box 2 when the inner frame is assembled from the blank 40. The rectangular cut-out 44 substantially corresponds to a front wall portion of the access opening 6 in the inner package 5.

To form the inner frame, the inner frame left and right side panels 42, 43 are folded approximately 90° with respect to the inner frame front panel 41. In the assembled condition, the inner frame front panel 41 corresponds to the inner frame front wall, and the inner frame left and right side panels 42, 43 correspond, respectively, to the inner frame left and right side walls.

Figure 21:
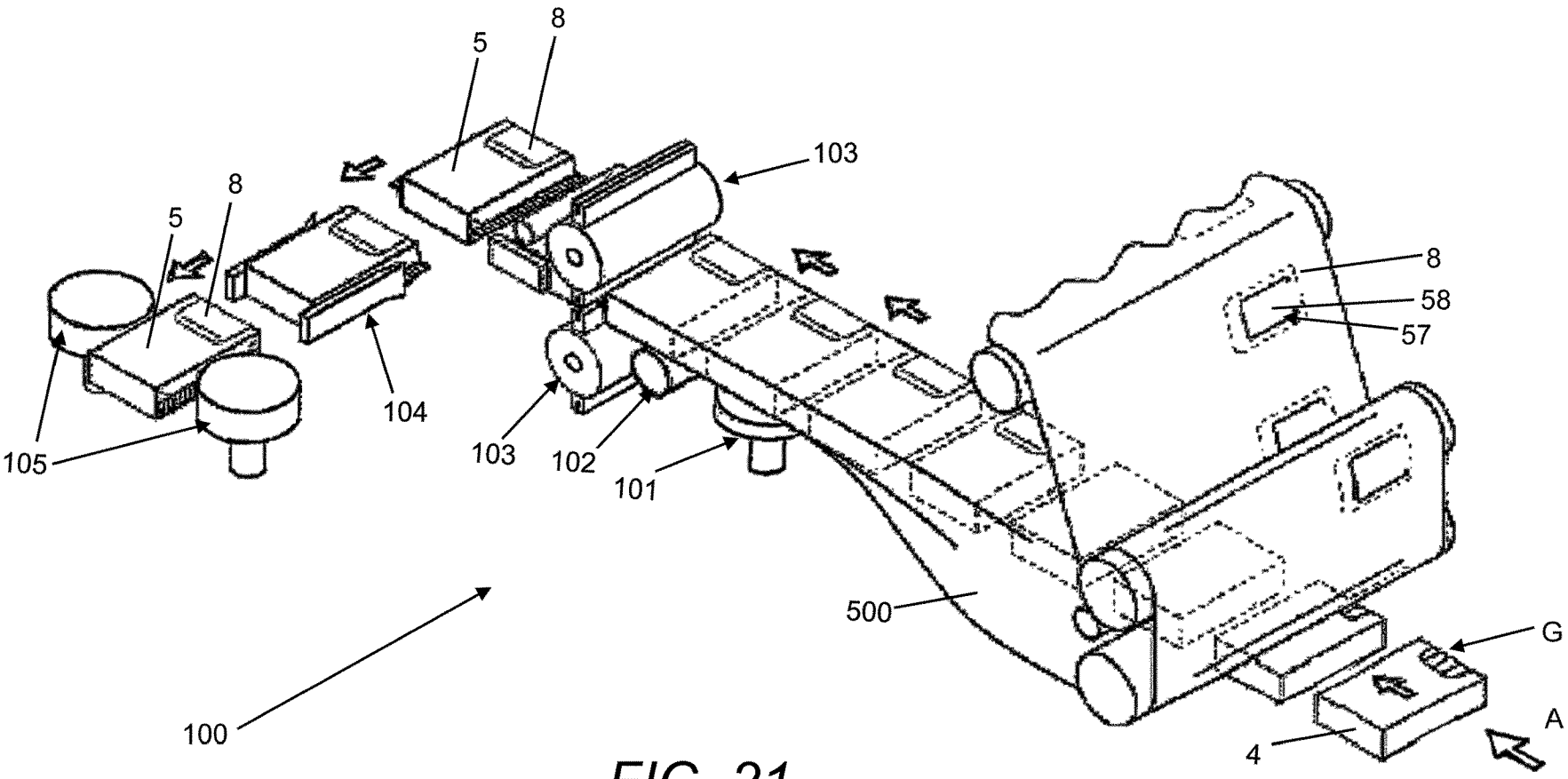
FIG. 21 shows a system for forming an inner package of the present invention.

FIG. 21 shows a system or apparatus 100 for forming an inner package 5 housing smoking articles, such as cigarettes or the like, according to one embodiment of this invention. A series of inner frames 4, each of which is respectively combined with a charge of cigarettes, is transported in direction of arrow A along a packaging path by apparatus 100. The framed charged cigarettes G are conveyed under a continuous sheet of wrapping material 500 (e.g. a metallised plastics laminate film) which is fed from a supply roll (not shown). The wrapping sheet 500 has pre-formed reclosable flaps 8 for alignment with the respective access apertures 44 in the inner frame front panel 41 of each inner frame 4 transported under the wrapping sheet 500.

Rollers 101 arranged below the serially progressing inner frames 4 draw the wrapping sheet 500 tautly over the front and back faces of the framed charge of cigarettes G and against opposite ends of the framed charge of cigarettes G, thereby wrapping the same to form inner package front, top, back and bottom walls. The rollers 101 then cooperate with a sealing head 102 to fuse or seal the drawn wrapping sheet 500 to form a transverse seam at the inner package back wall (not shown). A further elongate sealing head 103 (or pair thereof) following the rollers 101 then operate(s) to clamp and fuse a lateral seam (e.g. as a "fin seal") in the barrier sheet 500 between each of the framed charge of cigarettes G to form the inner package left and right side walls. Trimmers 104 and rollers 105 may then trim and flatten the seams 13, 14 to complete the individual inner packages 5.

A set of blanks for forming the outer housing 1 according to any of the embodiments represented in FIGS. 15 to 18 are folded and glued about the inner package 5 to form the box 2 and lid 3, as previously explained. A permanent adhesive is applied on the outer surface of the reclosable flap 8, particularly at its free edge 9, to connect the reclosable flap 8 to the first lid inner front panel 32. As a result, a container for consumer goods according to the invention is formed.

To pre-form the reclosable flaps 8 in the wrapping sheet 500, the access opening 6 is first cut into the wrapping sheet 500 to define a flap 58 (FIG. 19A) or a cut-out 59 (FIG. 19B) and next the reclosable flap 8 is positioned on the wrapping sheet 500 over the access opening 6. The reclosable flap 8 is positioned to cover the access opening 6.

In some embodiments, application of the permanent adhesive on the outer surface of the reclosable flap 8 may be carried out during formation of the outer housing about the inner package 5, preferably during a step of folding and gluing the lid portion 30 of the blank.

In other embodiments, application of the permanent adhesive is done after the outer housing is completely formed around the inner package 5. In this case, attachment of the reclosable flap 8 to the first lid inner front panel 32 requires the additional steps of creating a space or gap between the lid 3 and the inner package 5 to provide access to the free end 9 of the reclosable flap 8; and attaching the reclosable flap 8 to the first lid inner front panel 32 through or via the space or gap. The attaching step may comprise bringing the first lid inner front panel 32 and an outer surface of the reclosable flap 8 closely together, desirably into contact with one another, for example, by applying pressure to the lid 3.

For example, the hinged lid 3 may be moved relative to the box 2 from the closed position to an at least partially open position so as to create the space or gap between the hinged lid 3 and the inner package 5 through or via which the reclosable flap 8 and the first lid inner front panel 32 are attached to one another. A liquid permanent adhesive may then be provided through or via the space or gap at the free end 9 of the reclosable flap 8 and the hinged lid 3 may then be rotated back to the closed position.

Preferably, the hinged lid 3 is rotated relative to the box 2 through an angle of less than about 35°, for example of less than about 30°, for example of less than about 25°, or, for example, in a range of between about 8° and about 20°. By limiting the degree to which the hinged lid 3 is opened, the deleterious effects of the opening operation can be substantially avoided, while providing sufficient space to provide an effective attachment between the reclosable flap 8 and the first lid inner front panel 32.

The invention claimed is:

1. A container for consumer goods, comprising:

an outer housing comprising a hinged lid rotatable between open and closed positions;

an inner package of consumer goods within the outer housing comprising an access opening through which consumer goods can be removed, the access opening being covered by a reclosable flap, wherein the reclosable flap is attached to the hinged lid such that a portion of the reclosable flap is substantially coplanar with a planar wall of the hinged lid when the hinged lid moves between the open and closed positions; and an indicium provided by a printing medium;

wherein the hinged lid comprises a first lid panel attached to the reclosable flap, wherein the first lid panel is movable relative to a second lid panel during movement of the hinged lid between the open and closed positions, wherein the planar wall of the hinged lid is provided by the first lid panel;

wherein the indicium is provided at the portion of the reclosable flap that is coplanar with the planar wall, and wherein the indicium is provided at a position on the reclosable flap that is offset from the access opening when the hinged lid is in the closed position.

2. The container of claim 1, wherein the indicium is embedded in the reclosable flap.

3. The container of claim 1, wherein the indicium is provided at an inner surface of the reclosable flap.

4. The container of claim 1, wherein the indicium is provided at an outer surface of the reclosable flap.

5. The container of claim 1, wherein a protective layer is arranged to cover the printing medium to prevent egression of compounds therefrom to the consumer goods within the inner package.

6. The container of claim 1, wherein the indicium is text, a symbol, an image, a pattern, or a combination thereof.

7. A method of forming a container for consumer goods, comprising the steps of:

providing an inner package of consumer goods comprising an access opening through which consumer goods can be removed;

providing a reclosable flap to cover the access opening of the inner package, wherein the reclosable flap comprises an indicium provided by a printing medium;

folding a blank about the inner package to form an outer housing with a hinged lid; and attaching the reclosable flap to the hinged lid by attaching the reclosable flap to a first lid panel, wherein the step of folding the blank comprises a step of forming the hinged lid in a way such that the first lid panel can move relative to a second lid panel when the container is in use, wherein a planar wall of the hinged lid is provided by the first lid panel;

wherein the reclosable flap is attached to the hinged lid such that at least a portion of the reclosable flap with the indicium is substantially coplanar with the planar wall of the hinged lid when the hinged lid moves between open and closed positions, and wherein the indicium is provided at a position on the reclosable flap that is offset from the access opening when the hinged lid is in the closed position.

* * * * *